US009815099B2

(12) United States Patent
Cox, III et al.

(10) Patent No.: US 9,815,099 B2
(45) Date of Patent: Nov. 14, 2017

(54) METHODS AND APPARATUS TO DETERMINE A PLUNGE DEPTH POSITION OF MATERIAL CONDITIONING MACHINES

(71) Applicant: The Bradbury Company, Inc., Moundridge, KS (US)

(72) Inventors: Clarence B. Cox, III, McPherson, KS (US); Roger Downing, Hutchinson, KS (US)

(73) Assignee: The Bradbury Company, Inc., Moundridge, KS (US)

( * ) Notice: Subject to any disclaimer, the term of this patent is extended or adjusted under 35 U.S.C. 154(b) by 96 days.

(21) Appl. No.: 14/729,821

(22) Filed: Jun. 3, 2015

(65) Prior Publication Data

US 2016/0354818 A1 Dec. 8, 2016

(51) Int. Cl.

| | |
|---|---|
| ***B21B 37/16*** | (2006.01) |
| ***B21F 1/02*** | (2006.01) |
| ***B21B 1/22*** | (2006.01) |

(52) U.S. Cl.

CPC ..... *B21B 37/16* (2013.01); *B21B 1/22* (2013.01); *B21F 1/02* (2013.01)

(58) Field of Classification Search

CPC ..... B21B 37/16; B21B 1/22; B21B 1/102; B21D 1/02; B21D 3/02

See application file for complete search history.

(56) References Cited

U.S. PATENT DOCUMENTS

2009/0113973 A1* 5/2009 Cox, III ..... B21B 15/00 72/165
2015/0013418 A1* 1/2015 Abe ..... B21D 1/02 72/163

FOREIGN PATENT DOCUMENTS

| | | |
|---|---|---|
| DE | 102010061841 | 5/2012 |
| JP | 53144821 | 6/1988 |
| JP | 2001212616 | 8/2001 |
| JP | 2004314150 | 11/2004 |

OTHER PUBLICATIONS

Machine translation of JP63144821 obtained using the J-PLAT system from the Japanese Patent Office dated Feb. 15, 2017, Ushio, pp. 1-6.*

European Patent Office, "European Search Report", issued in connection with International application No. 16172435, dated Sep. 26, 2016, (6 pages).

(Continued)

*Primary Examiner* — Teresa M Ekiert

(74) *Attorney, Agent, or Firm* — Hanley, Flight & Zimmerman, LLC

(57) ABSTRACT

Methods and apparatus to determine a plunge depth position of material conditioning machines are disclosed. An example method for setting a plunge depth of a leveler includes incrementally adjusting, via an actuator, a first work roll relative to a second work roll between a plurality of incremental plunge depth positions; measuring a pressure value in the actuator at the respective incremental plunge depth positions; associating the measured pressure values with the corresponding incremental plunge depth positions; detecting a smallest one of the measured pressure values; and identifying a first one of the incremental plunge depth positions corresponding to the smallest one of the measured pressure values.

22 Claims, 12 Drawing Sheets

(56) References Cited

OTHER PUBLICATIONS

Australian Intellectual Property Office, "Examination Report No. 1," issued in connection with Australian Patent Application No. 2016203702, dated Feb. 7, 2017, 3 pages.
Canadian Intellectual Property Office, "Examination Report," issued in connection with Canadian Patent Application No. 2,931,465, dated May 12, 2017, 3 pages.

* cited by examiner

METHODS AND APPARATUS TO DETERMINE A PLUNGE DEPTH POSITION OF MATERIAL CONDITIONING MACHINES

FIELD OF THE DISCLOSURE

The present disclosure relates generally to material conditioning machines and, more particularly, to apparatus and methods to determine a plunge depth position of material conditioning machines.

BACKGROUND

Material conditioners have long been used in processing strip material used in connection with mass production or manufacturing systems. In a manufacturing system, a strip material (e.g., a metal) is typically removed from a coiled quantity of the strip material. However, uncoiled rolled metal or strip material may have certain undesirable characteristics such as, for example, coil set, crossbow, edge-wave and centerbuckle, etc. due to shape defects and internal residual stresses resulting from the manufacturing process of the strip material and/or storing the strip material in a coiled configuration.

To achieve a desired material condition, a strip material removed from a coil often requires conditioning (e.g., flattening and/or leveling) prior to subsequent processing in a roll forming machine or laser cutter. For optimum part production, a strip material should have uniform flatness along its cross-section and longitudinal length and be free from any shape defects and any internal residual stresses. Flatteners and/or levelers can substantially flatten a strip material to eliminate shape defects and/or release the internal residual stresses as the strip material is uncoiled from the coil roll.

DETAILED DESCRIPTION

Figure 1:
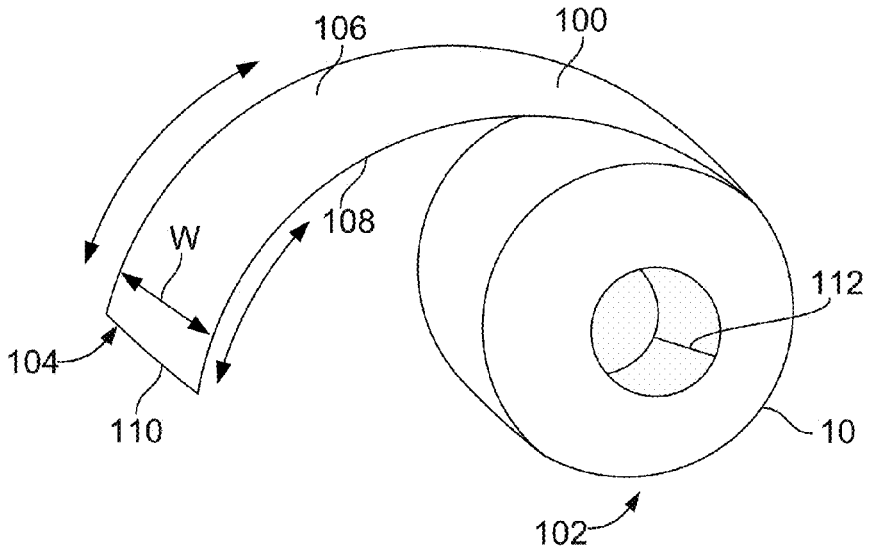
FIG. 1 illustrates an example strip material in a coil condition.

FIG. 1 illustrates a strip material 100 in a coiled state or condition 102. Coiled strip material frequently manifests undesirable material conditions that are the result of longitudinal stretching of the strip material 100 during coiling and as a result of remaining in the coiled condition 102 for a period of time. In particular, the coil winding process is usually performed under high tension, which may cause a condition commonly referred to as coil set. If significant, coil set may also manifest itself as a condition commonly referred to as crossbow. Both of these undesirable conditions are manifest in an uncoiled condition or state 104 when the strip material 100 is unwound from a roll or coil 10. Due to being in the coiled condition 102, an upper surface 106 of the strip material 100 is longer (e.g., bent along a longitudinal axis of the strip material 100) relative to an inner surface 108 of the strip material 100. As a result, the upper surface 106 of the strip material 100 tends to curl toward the inner surface 108 of the strip material 100. As the uncoiled portion 104 is pulled straight, a varying coil set effect in the strip material 100 between a leading edge 110 and a trailing edge 112 causes the longer upper surface 106 to curl or bend (e.g., inward) relative to the shorter inner surface 108.

Undesirable material conditions such as coil set and crossbow can be substantially eliminated using leveling or flattening techniques. Leveling and/or flattening techniques are implemented based on the manners in which strip materials react to stresses imparted thereon (e.g., the amount of load or force applied to a strip material). For example, the extent to which the structure and characteristics of the strip material 100 change is, in part, dependent on the amount of load, force, or stress applied to the strip material 100.

Figure 2:
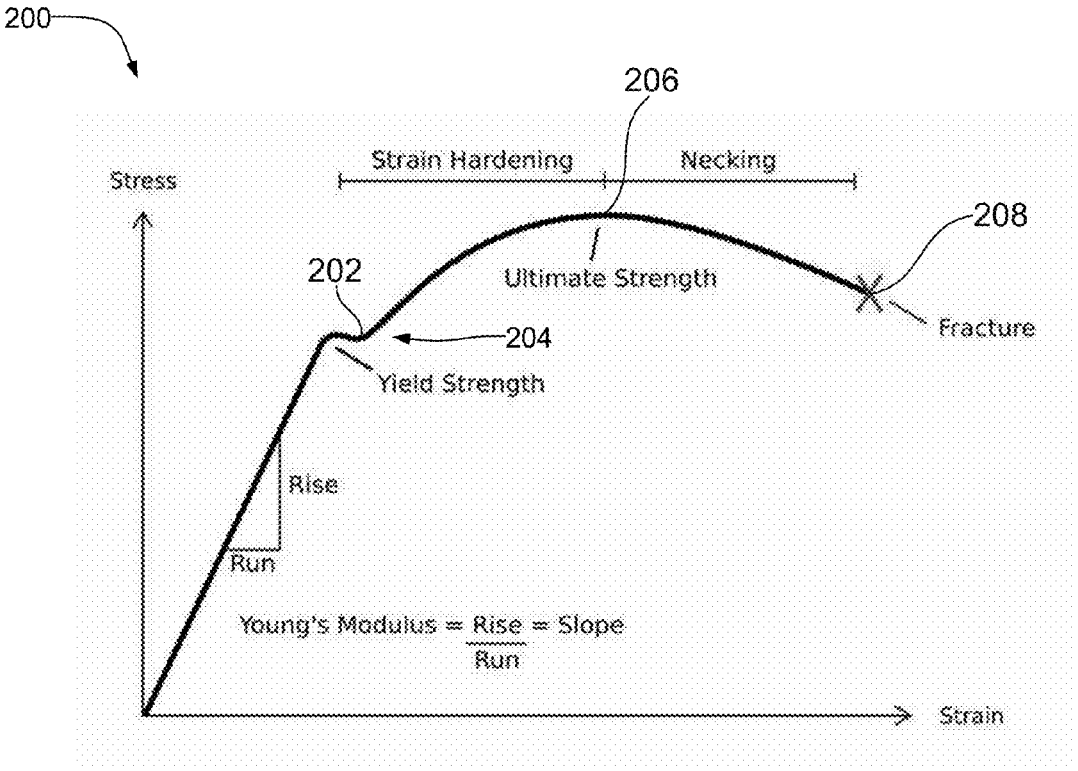
FIG. 2 illustrates an example stress-strain graph of a material.

For example, FIG. 2 illustrates an example stress-strain graph 200 of a material such as, for example, aluminum or other type of metal. Based on Hooke's law, material remains elastic and returns to its original shape until the material passes Young's modulus of elasticity at which time a yield point 202 of the material is exceeded, and the material enters into a state of plasticity. The amount of stress causing a metal or a material to change from an elastic condition to a plastic condition is commonly known as the yield strength. A hook 204 shown on the stress-strain graph 200 is typically representative of an indication that the yield point 202 of a material is met. In some instances, applying a stress to the material greater than the yield point 202 of the strip material 100 (e.g., an Ultimate Strength 206) may cause the material to be over stressed. As a result, the strip material 100 may harden and/or form dislocations in the strip material 100. For example, a stress applied to the strip material 100 that is representative of an ultimate stress value of a material may cause the strip material to harden. In other words, applying a stress on the material at approximately the yield point 202 of the strip material causes internal stresses in the strip material to release, but applying a stress to the strip material 100 significantly greater than the yield point 202 of the strip material 100 adds internal stresses to the strip material 100 and/or causes the strip material 100 to harden. A strip material 100 that is hardened may provide undesired shape characteristics for downstream processing equipment such as, for example, laser cutters, forming equipment, shearing equipment, etc. Additionally or alternatively, applying a stress to the strip material 100 that is greater than the yield point 202 may decrease an efficiency of a leveler and/or may cause damage to the leveler. A stress applied to the strip material 100 that is greater than a fracture stress 208 causes the strip material 100 to crack, break or become damaged.

Levelers typically bend a strip material back and forth through a series of work rolls to reduce internal stresses (and reduce undesired characteristics) by permanently changing the memory of the strip material 100. More specifically, the work rolls are positioned or nested to a plunge depth position required to plastically deform the strip material. In particular, a plunge depth positioned to apply a stress to the strip material approximate the yield point 202 of the strip material 100 results in a maximum reduction of internal stresses.

Figure 3A:
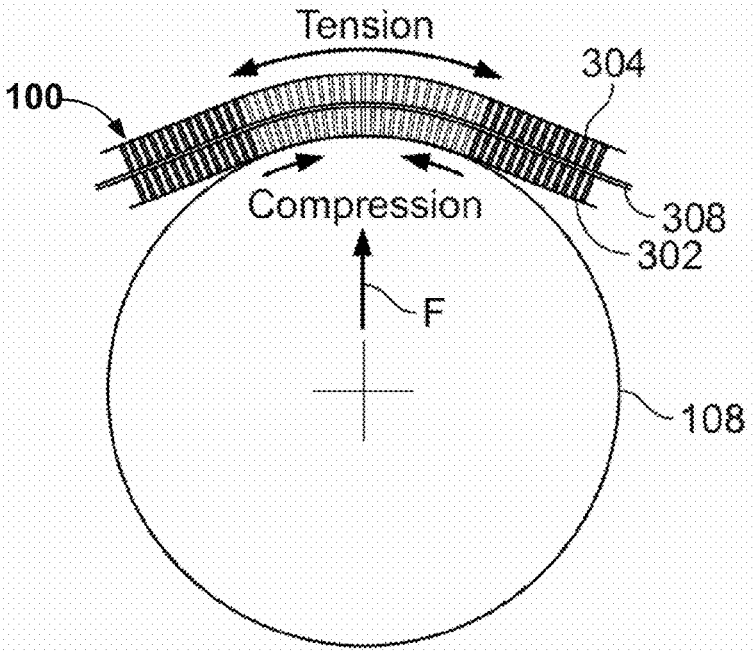
FIG. 3A illustrates example areas of compression and tension on a section of a strip material engaged by a work roll.

FIG. 3A illustrates example areas of compression and tension on a section of the strip material 100 passing over a work roll 108 of a leveler. The magnitude of the forces used to condition the strip material 100 depends on the type or amount of reaction the strip material 100 has to being wrapped or bent about a surface of the work roll 108. For purposes of discussion, the strip material 100 is described herein as if the strip material 100 were formed using planar layers. As shown in FIG. 3A, the work roll 108 is typically used to apply a load (i.e., a plunge force F) to the strip material 100. The plunge force F applied by the work roll 108 to the strip material 100 is created by increasing a plunge of the work roll 108 toward the strip material 100. The plunge force F causes a bottom surface 302 of the strip material 100 to be in compression and a top surface 304 of the strip material 100 to be in tension. A neutral axis 308 shown along the center of the strip material 100 is neither in compression nor tension. Deforming the strip material 100 in this manner causes the strip material 100 to bend or stretch.

Figure 3B:
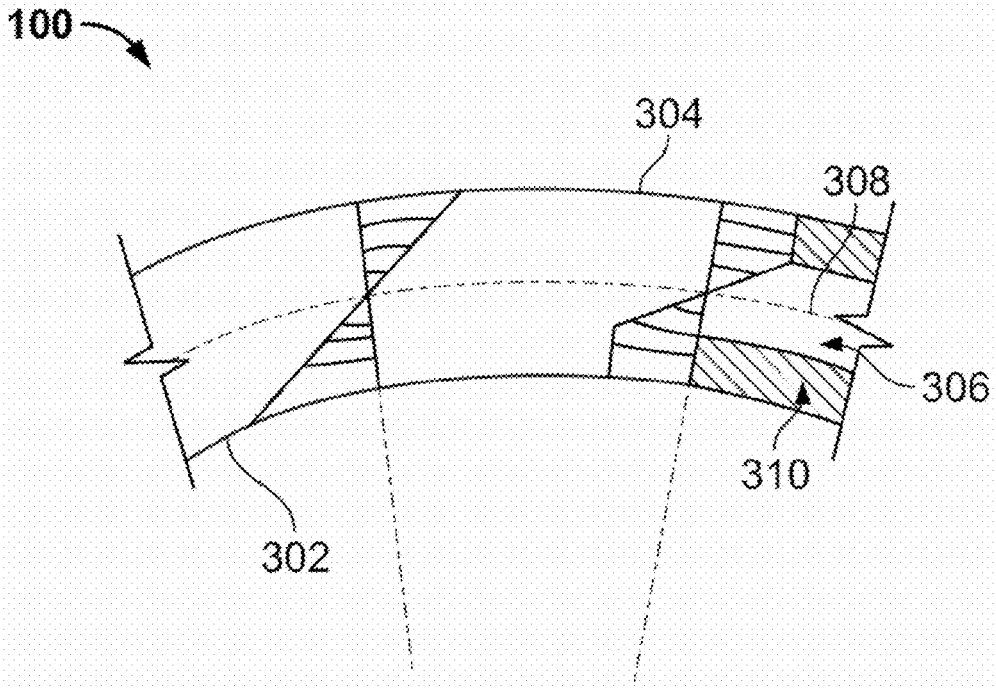
FIG. 3B illustrates the effect of plastic deformation of a strip material resulting from a plunge force applied by a work roll against the strip material.

FIG. 3B illustrates an elastic region 306 and a plastic region 310 in the strip material 100. Bending the strip material 100 using a relatively low plunge force F maintains the material in an elastic phase represented by the elastic region 306 about the neutral axis 308. In an elastic phase, residual stresses of a strip material 100 remain unchanged. To substantially reduce or eliminate residual stresses, the strip material 100 must be stretched beyond the elastic phase to a plastic phase represented by the plastic region 310. That is, the strip material 100 must be stretched so that the plastic region 310 extends substantially the entire thickness of the strip material 100. Otherwise, when the plunge force F applied to a portion of the strip material 100 is removed without having stretched portions (e.g., between 70% and 80%) of the strip material 100 to the plastic phase, the residual stresses remain in those portions of the strip material 100 causing the strip material 100 to return to its shape prior to the force being applied. In such an instance, the strip material 100 has been flexed, but has not been bent.

The plunge force F applied to the strip material 100 can be increased to transition the material from the elastic phase to the plastic phase to substantially reduce or eliminate the residual stresses of the strip material 100 that cause undesired characteristics or deformations. Specifically, small increases in the force or load applied to the strip material 100 cause relatively large amounts of stretching (i.e., deformation) to occur in the plastic region 310.

In known leveling systems, the amount of plunge force F needed to exceed the yield strength of a material is determined based on the diameters of the work rolls, the horizontal separation between neighboring work rolls, Young's modulus of elasticity, a yield strength of the material, and a thickness of the material. Leveler manufacturers may provide a chart of start-up settings that help an operator achieve a proper plunge amount based on input values including a material thickness and material yield strength given that all other parameters such as work roll diameter and/or work roll horizontal separation are fixed values. However, it is often difficult to precisely determine the yield strength and/or the yield point. Although material thickness is easily measurable, the yield of the material is rarely displayed on the coil, causing most operators to guess the yield strength value of the material. Consequently, an incorrect yield strength value is often employed leading to an improper and/or less effective plunge depth. Additionally, some materials, such as steel, are often rated by grade. For example, grade A36 steel is a softer material that has a yield strength range between approximately 30,000 and 45,000 pounds/in$^2$ (psi). Grade G50 steel typically has a yield strength range between approximately 50,000 psi and 65,000 psi. Grade G65 steel typically has a yield strength range between approximately 65,000 psi and 80,000 psi. Thus, the yield strength of a rated material varies significantly. For example, an operator can determine that the yield strength for G50 rated steel is 50,000 psi, but the actual yield strength of that particular roll of material is 65,000 psi. As a result, the plunge depth of the leveler apparatus may not be set to a sufficient depth needed to plastically deform the strip material. Thus, although some operators estimate yield strength of a rated material that is within a range provided for that given rated material, the estimated yield strength may still be insufficient to plastically deform the strip material. In some instances, the accuracy of the estimated yield strength significantly deviates from the actual yield stress by approximately between 5% and 15%. Such deviation often results in less effective leveling and/or provides a processed strip material that does not comply with a specified percent of cross-section area yield in the plastic region. For example, some compliance restrictions require 80% of a cross-section area of the strip material (e.g., outer surfaces extending toward the center axis) to be processed in the plastic region and 20% of the cross-section area (e.g., extending from the center axis) to be processed in the elastic region. Alternatively, for example, an operator can determine that the yield strength for a G50 rated steel is 65,000 psi, but the actual yield strength of that particular roll of material is 50,000 psi. As a result, the plunge depth may be set to impart a stress that is significantly greater than the yield strength, which results in material hardening by imparting too much stress to the strip material.

The example methods and apparatus described herein detect or estimate a plunge depth without requiring yield strength input from an operator. In particular, the example method and apparatus disclosed herein determine a plunge depth position required to impart a stress within a threshold (e.g., deviating by less than about 3%) of an actual yield strength of a given strip material to be processed by the example leveler apparatus disclosed herein. For example, the example methods and apparatus determine a plunge depth that provides a stress or force to the strip material that is between approximately 0.1% and 5% of the actual yield strength of the strip material. As a result, adjusting a plunge depth representative of a stress corresponding to an approximate yield point of the strip material to be processed by the example levelers disclosed herein provides optimal material conditioning because processing the strip material at or substantially close (e.g., within about 0.1 and 10%) to the yield point provides the greatest effective internal stress reduction. For example, the greatest release of internal stresses occurs when the strip material is processed at its yield point. As a result, stresses in the strip material are significantly reduced to provide significantly improved flatness properties and/or flat laser burning properties in the strip material after leveling.

To detect or determine a plunge depth associated with and/or corresponding to the yield strength of a strip material, the example methods and apparatus disclosed herein measure, monitor or detect a pressure associated with a cylinder of the leveler. For example, a pressure of a control fluid (e.g., pressurized hydraulic oil) used to adjust a plunge depth of a work roll in a particular zone may be monitored or measured as a plunge depth is adjusted incrementally (e.g., a preset or predetermined incremental value) during a set-up condition. For example, the pressurized control fluid may be provided to a piston or cylinder of an actuator (e.g., a hydraulic actuator) to adjust a plunge depth of a work roll.

To detect, monitor or sense a pressure of the control fluid in the actuator (and, thus, a vertical force imparted to the strip material via the work roll) when the work roll is nested or in a plunge position, the example methods and apparatus disclosed herein detect or sense forces imparted to the strip material by the work rolls based on changes in pressure of a control fluid in a cylinder of an actuator when the plunge depth is adjusted (e.g., increased or decreased incrementally) during, for example, a set-up operation. In this manner, the detected or sensed force provides an indication of whether a force applied to the strip material based on a current plunge depth position of the work rolls is sufficient to deform the strip material at approximately its yield strength. Specifically, during a set-up operation, a plunge depth is adjusted incrementally between an initial value and a final value. At each incremental plunge depth position, a pressure reading of the control fluid of a cylinder is measured. For example, pressure readings of only a central cylinder (e.g., aligned with a longitudinal axis of the strip material) are measured at each of the incremental plunge depths. Once all the pressure readings have been measured at each of the incremental plunge depths between the initial and final plunge depth positions, the pressure readings are compared. The smallest or lowest pressure reading is detected. The smallest or lowest pressure corresponds approximately to the yield point of the strip material. The plunge depth corresponding to the detected smallest pressure reading is identified. During operation, the strip material is processed at the identified plunge depth. The material is processed based on the plunge depth corresponding to the smallest or lowest detected pressure, which provides a stress to the strip material that is approximately the yield point of the strip material.

In some examples, the pressure readings of a control fluid in two or more cylinders representative of different zones across the width of the strip material are measured. An average of the smallest pressure readings is determined and the plunge depth is provided at a plunge depth associated with the average pressure value. In some examples, the smallest pressure reading for each of the zones is determined and a plunge depth of each zone is adjusted to a position corresponding to the smallest pressure reading in that particular zone. Thus, in some such examples, the plunge depth adjustment of each zone is independent of the other plunge depth adjustments of the other zones.

Figure 4:
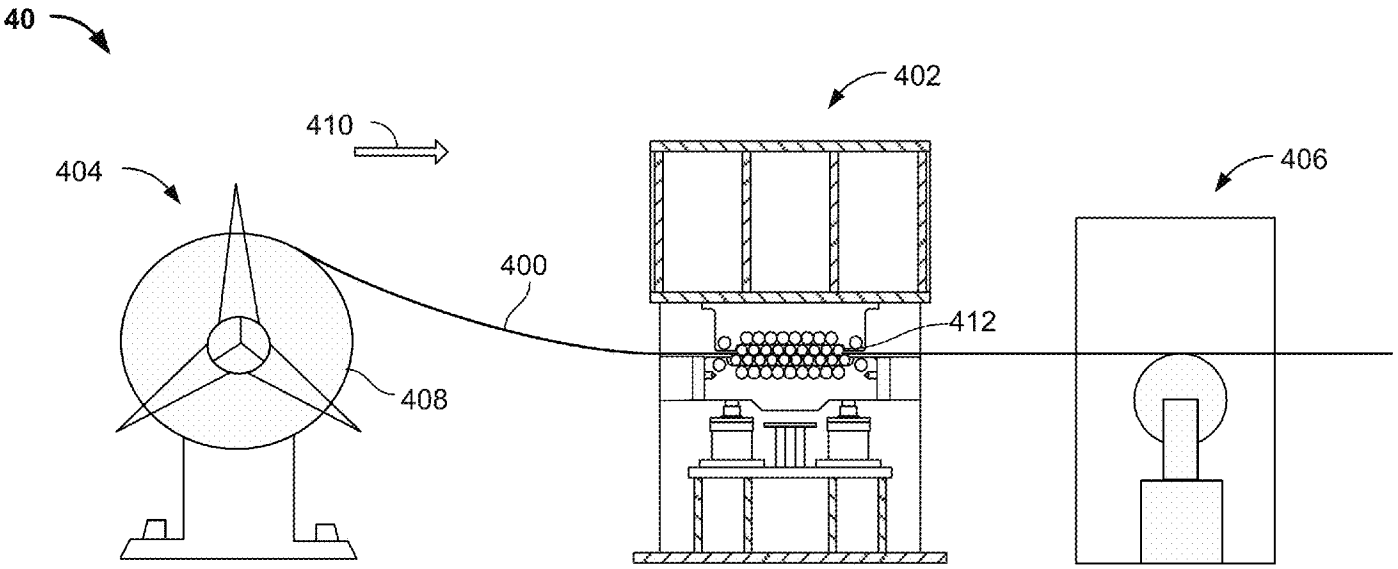
FIG. 4 is a side view of an example production system having an example leveler configured to process a moving strip material in accordance with the teachings disclosed herein.

FIG. 4 illustrates an example production system 40 configured to process a moving strip material 400 using an example leveler 402 disclosed herein. In some example implementations, the example production system 40 may be part of a continuously moving strip material manufacturing system, which may include a plurality of subsystems that modify, condition or alter the strip material 400 using processes that, for example, level, flatten, punch, shear, and/or fold the strip material 400. In alternative example implementations, the leveler 402 may be implemented as a standalone system.

In the illustrated example, the example leveler 402 may be placed between an uncoiler 404 and a subsequent operating unit 406. The strip material 400 may be a metallic substance such as, for example, steel or aluminum, or may be any other suitable material. In a coiled state, the strip material 400 may be subject to variable and asymmetrical distribution of residual stresses along its width and length that cause shape defects in the strip material 400. As the strip material 400 is uncoiled or removed from a coiled roll 408, it may assume one or more uncoiled conditions or shape defects such as, for example, coil set and crossbow.

To condition the strip material 400 and remove internal stresses that may cause the uncoiled conditions such as coil set, the strip material 400 travels from the uncoiler 404, through the leveler 402, and to the subsequent operating unit 406 in a direction generally indicated by arrow 410. The subsequent operating unit 406 may be a continuous material delivery system that transports the strip material 400 from the leveler 402 to a subsequent operating process such as, for example, a punch press, a shear press, a roll former, a laser cutter, etc. For example, during the leveling operation, subsequent operations may be performed as the strip material 400 moves continuously through the leveler 402 (e.g., a cutting operation performed by a laser cutter). In other example implementations, sheets precut from, for example, the strip material 400 can be sheet-fed through the leveler 402.

The leveler 402 of the illustrated example employs a plurality of work rolls 412 to reshape or work the strip material 400 to reduce coil set and/or the internal stresses in the strip material 400 and to impart a flat shape on the strip material 400 as the strip material 400 leaves the leveler 402. In particular, a force is imparted to the strip material by the work rolls 412 to condition the strip material 400.

Figure 5:
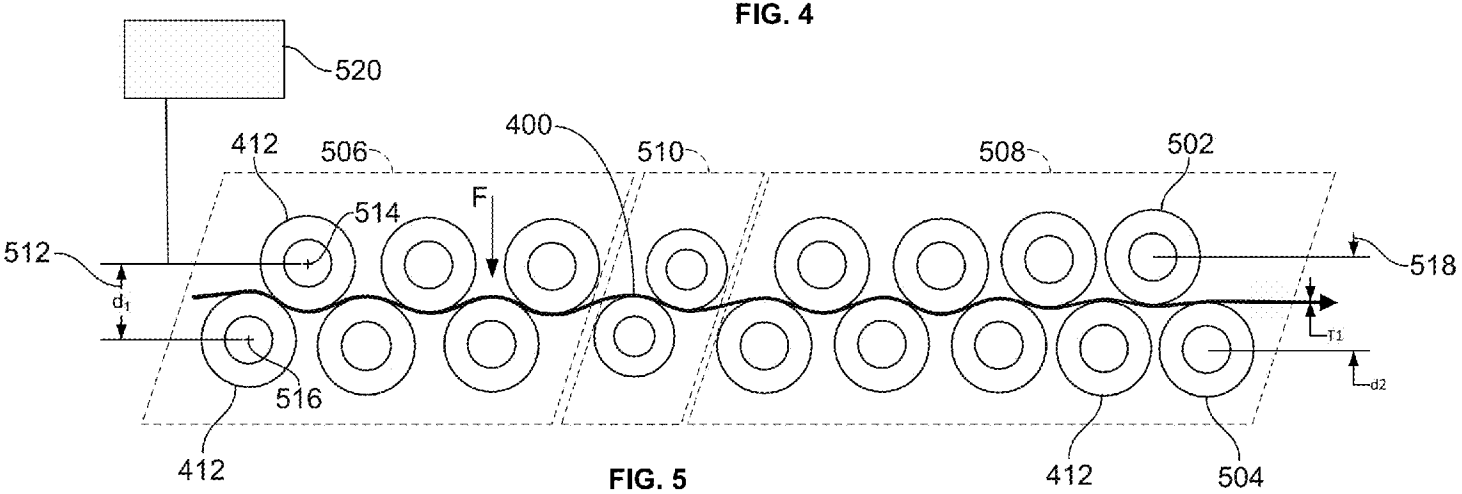
FIG. 5 illustrates an example configuration of work rolls of the example leveler of FIG. 4.

FIG. 5 illustrates an example configuration of the work rolls 412 of the example leveler 402 of FIG. 4. As shown in the illustrated example of FIG. 5, the plurality of work rolls 412 of the leveler 402 arranged as a plurality of upper work rolls 502 and lower work rolls 504. To reshape or work the strip material 400, the upper work rolls 502 and the lower work rolls 504 are arranged in an offset relationship (e.g., a nested or alternating relationship) relative to one another on opposing sides of the strip material 400 being processed to create a material path that wraps above and below opposing surfaces of the alternating upper work rolls 502 and lower work rolls 504. Engaging opposing surfaces of the strip material 400 using the upper work rolls 502 and lower work rolls 504 in such an alternating fashion facilitates releasing the residual stresses in the strip material 400 to condition (e.g., flatten, level, etc.) the strip material 400.

In the illustrated example, the work rolls 502 and lower work rolls 504 are partitioned into a plurality of entry work rolls 506 and a plurality of exit work rolls 508. The entry work rolls 506 may be driven independent of the exit work rolls 508, and the entry work rolls 506 can be controlled independent of the exit work rolls 508. The entry work rolls 506 reshape the strip material 400 by reducing the internal stresses of the strip material 400. The exit work rolls 508 adjust any remaining internal stresses of the strip material 400 to impart a flat shape on the strip material 400 as the strip material 400 leaves the leveler 402. The leveler 402 of the illustrated example may also employ a plurality of idle work rolls 510 positioned between and in line with the entry work rolls 506 and the exit work rolls 508. For example, the entry work rolls 506 and the exit work rolls 508 may be driven via, for example, a motor, and the idle work rolls 510 may non-driven (but can be driven in some implementations).

The magnitudes of the forces used to condition the strip material 400 depend on the type or amount of reaction the strip material 400 has to being wrapped or bent about a surface of the work roll 412. As shown in FIG. 5, the work roll 412 is used to apply a load (i.e., a plunge force F) to the strip material 400. The plunge force F applied by the work roll 412 to the strip material 400 is created by increasing a plunge of the work roll 412 toward the strip material 400. More specifically, to vary the plunge force, a work roll plunge can be varied by changing a center distance ($d_1$) or plunge depth position 512 between center axes 514 and 516 of the respective work rolls 502 and lower work rolls 504. In general, for any given work roll plunge depth or plunge, a decreased center distance increases the tensile stress imparted to the strip material 400 and, thus, the potential for plastic deformation, which conditions the strip material 400. In the illustrated example, the plunge of the entry work rolls 506 is set to deform the strip material 400 at or beyond its yield strength and, thus, the plunge of the entry work rolls 506 is relatively greater than a plunge 518 ($d_2$) of the exit work rolls 508. In some example implementations, the plunge 518 of the exit work rolls 508 can be set so that they do not deform the strip material 400 by any substantial amount but, instead, adjust the shape of the strip material 400 to a flat shape (e.g., the plunge 518 of the exit work rolls 508 is set so that a separation gap between opposing surfaces of the upper and lower work rolls 502 and 504 is substantially equal to a thickness $T_1$ of the strip material 400). Applying a relatively greater plunge (i.e., a smaller distance between the work roll center axes 502*a* and 502*b*) at the entry work rolls 502 requires a relatively stronger plunge force to reduce a substantial amount of internal stresses (e.g., 70%, 80%, etc.) that are trapped in the strip material 100 by stretching and/or elongating the strip material 100. As disclosed below, a controller 520 determines a plunge depth (e.g., the plunge depth position 512) of the entry work rolls 506 that imparts a stress to the strip material 400 that is approximately the actual yield strength of the strip material 400. In particular, the controller 520 determines the plunge depth position 512 without requiring an operator to estimate or guess the yield strength of the strip material 400 during a set-up operation.

Figure 6:
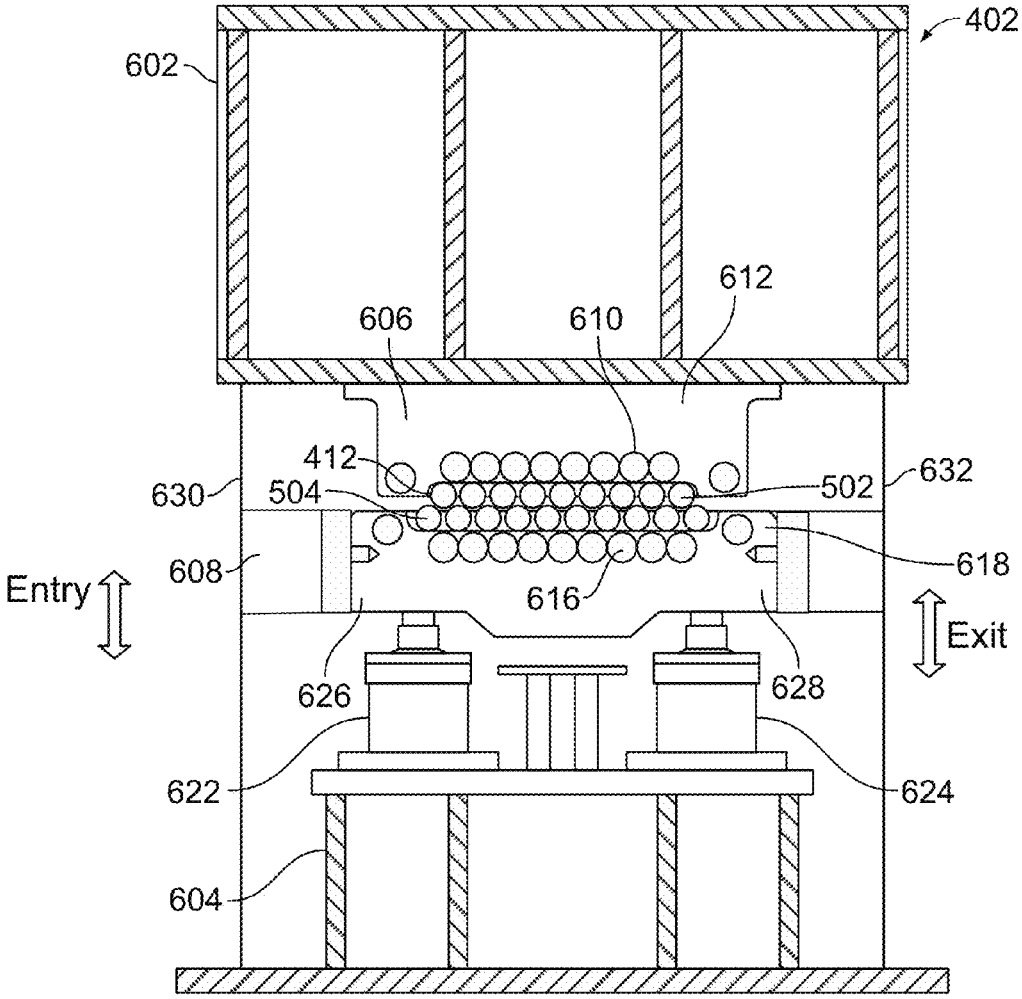
FIG. 6 is a side view illustration of the example leveler of FIGS. 4-5.

FIG. 6 illustrates a side view of the example leveler 402 of FIG. 4. Referring to FIG. 6, the leveler 402 has an upper frame 602 and a bottom frame 604. The upper frame 602 includes an upper backup 606 mounted thereon and the bottom frame 604 includes an adjustable backup 608 mounted thereon. In the illustrated example of FIG. 6, the upper backup 606 is non-adjustable and fixed to the frame 602 and the adjustable backup 608 is adjustable relative to the upper backup 606. However, in other example implementations, the upper backup 606 may also be adjustable.

The upper backup 606 includes a row of backup bearings 610 supported by a non-adjustable flight 612 and the plurality of upper work rolls 502 that are supported by the upper backup bearings 610. Thus, the upper backup bearings 610 fix the upper work rolls 502 in place. The adjustable backup 608 includes a row of lower backup bearings 616 supported by an adjustable flight 618. The lower backup bearings 616 support the plurality of lower work rolls 504. In some examples, intermediate rolls (not shown) may be positioned between the backup bearings 610 and the upper work rolls 502 and/or between the lower backup bearings 616 and the lower work rolls 504 to substantially reduce or eliminate work roll slippage that might otherwise damage the strip material 400 or mark relatively soft or polished surfaces of the strip material 400. Generally, journals (not shown) rotatably couple the upper work rolls 502 and the lower work rolls 504 to the frame 602 to allow rotation of the upper work rolls 502 and the lower work rolls 504. The work rolls 412 are small in diameter and are backed up by the respective backup bearings 610 and 616 to prevent unwanted deflection along the length of the work rolls 412.

In the illustrated example, the leveler 402 uses the adjustable backup 608 (i.e., adjustable flights) to adjust the plunge or a position of the lower work rolls 504 relative to the fixed upper work rolls 502. More specifically, actuators or hydraulic cylinders 622 and 624 move the lower backup bearings 616 via the adjustable flight 618 to increase or decrease a plunge depth between the upper work rolls 502 and the lower work rolls 504 (e.g., to increase or decrease the plunge depth position 512 and/or the plunge depth position 516 between the upper work rolls 502 and the lower work rolls 504 of the entry work rolls 506 or the exit work rolls 508). In particular, the leveler 402 can change the length of the strip material 400 by adjusting the position of the lower work rolls 504 relative to the upper work rolls 502 via the hydraulic cylinders 622 and 624 to create a longer path. Creating a longer path by increasing a plunge of the upper work rolls 502 and the lower work rolls 504 causes the strip material 400 to stretch and elongate further than a shorter path created by decreasing a plunge of the upper work rolls 502 and the lower work rolls 504. Adjustment of the lower work rolls 504 relative to the fixed upper work rolls 502 may enable substantially continuous or stepwise variation of the plunge of the work rolls 412, thereby enabling a substantially continuous or stepwise variation of the stress imparted to the strip material 400.

In the illustrated example of FIG. 6, the hydraulic cylinder 622 moves a first end 626 of the adjustable flight 618 relative to a second end 628 of the adjustable flight 618 to adjust a position of the lower work rolls 504 relative to the upper work rolls 502 at an entry 630 of the leveler 402 (e.g., the plunge depth position 512 of the entry work rolls 506 of FIG. 5). The hydraulic cylinder 624 moves the second end 628 of the adjustable flight 618 relative to the first end 626 to adjust the position of the lower work rolls 504 relative to the upper work rolls 502 at an exit 632 of the leveler 402 (e.g., the plunge depth position 516 of the exit work rolls 508 of FIG. 5). In this manner, the lower backup bearings 616 supported adjacent the first end 626 of the adjustable flight 618 can be positioned at a first distance or height relative to the fixed upper work rolls 502 adjacent the entry 630, and the lower backup bearings 616 supported adjacent the second end 628 of the adjustable flight 618 can be positioned at a second distance or height (e.g., different from the first height) relative to the fixed upper work rolls 502 adjacent the exit 632. In other example implementations, the position or plunge of the work rolls 412 can be adjusted by moving the upper backup 606 with respect to the adjustable backup 608 using, for example, motor and screw (e.g., ball screw, jack screw, etc.) configurations.

Figure 7:
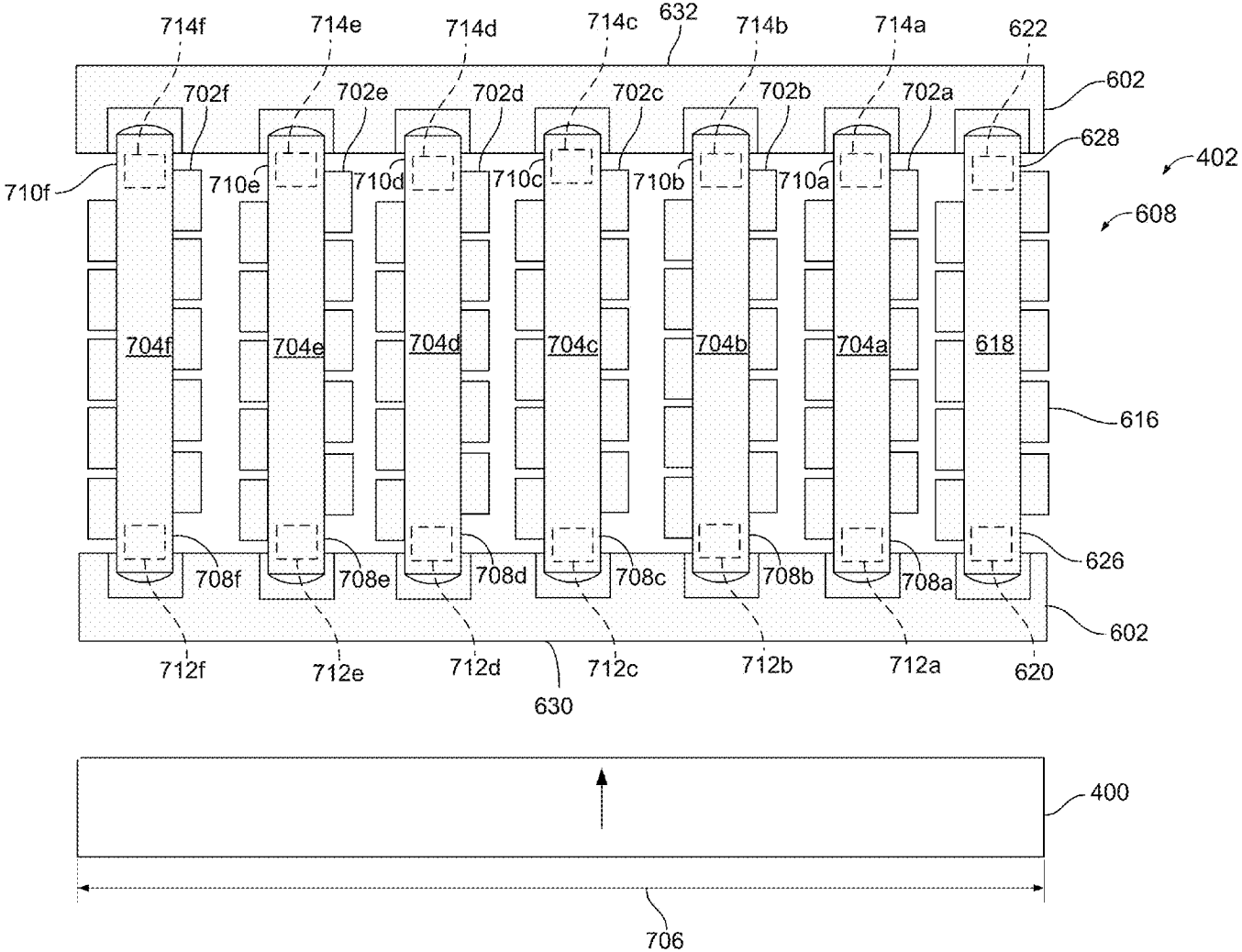
FIG. 7 is a plan view of a portion of the example leveler of FIGS. 4-6.

FIG. 7 illustrates a plan view of the adjustable backup 608 of the leveler 402 of FIG. 6. Referring to FIG. 7, the adjustable backup 608 of the leveler 402 includes a plurality of backup bearings 616 and 702*a-f* supported by a respective plurality of adjustable flights 618 and 704*a-f* extending across a width 706 (e.g., a cross-width) of the strip material 400. More specifically, the movable or adjustable backup bearings 616 and 702*a-f* are arranged on independently movable or adjustable flights 618 and 704*a-f*. For example, the adjustable flights 618 and 704*a-f* slide relative to the frame 602 to move the respective backup bearings 616 and 702*a-f* relative to respective upper backup bearings (e.g., backup bearings 610 of FIG. 6). For example, each respective first ends 626, 708*a-f* of the adjustable flights 618 and 704*a-f* slide or move independently relative to the entry 630 of the frame 602, and the second ends 628 and 710*a-f* of the adjustable flights 618 and 704*a-f* slide or move independently relative to the exit 632 of the frame 602 and/or the respective first ends 626 and 708*a-f*. In this manner, a plunge depth can be varied across the width 706 (e.g., a cross-width) of the strip material 400 as shown in FIG. 8 to provide or cause the work rolls 412 to impart a stress or force across the width W of the strip material 400.

As shown in FIG. 7, a plurality of actuators 620, 622, 712*a-f* and 714*a-f* are associated with respective ones of the adjustable flights 618 and 704*a-f*. For example, the entry 630 of the leveler 402 includes actuators 620 and 712*a-f*, and the exit 632 of the leveler 402 includes actuators 622 and 714*a-f*. Each of the actuators 620, 622, 712*a-f* and 714*a-f* moves independent of the other actuators. In particular, the actuators 620, 622, 712*a-f* and 714*a-f* (e.g., hydraulic actuators) may be controlled to adjust the positions of the respective ones of the adjustable flights 618 and 704*a-f* independently from other ones of the adjustable flights 618 and 704*a-f*. More specifically, respective ones of the actuators 620 and 712*a-f* adjust the respective first sides 626 and 708*a-f* of the adjustable flights 618 and 704*a-f*, and respective ones of the actuators 622 and 714*a-f* adjust the respective second sides 628 and 710*a-f* of the adjustable flights 618 and 704*a-f*. In this manner, the work rolls 412 at the entry 630 of the leveler 402 (e.g., the entry work rolls 506 of FIG. 5) may be positioned to a plunge depth (e.g., the plunge depth position 512 ($d_1$) of FIG. 5) that is greater than a plunge depth (e.g., the plunge depth position 516 ($d_2$) of FIG. 5) of the work rolls 412 at the exit 632 of the leveler 402 (e.g., the exit work rolls 508 of FIG. 5). Additionally or alternatively, a plunge depth of the work rolls 412 supported by one of the adjustable flights 618 and 704*a-f* at the entry 630 (and/or the exit 632) of the leveler 402 may vary across the width 706 of the strip material 400 relative to another adjacent work roll 412 supported by another one of the adjustable flights 618 and 704*a-f* at the entry 630 (and/or the exit 632).

Figure 8:
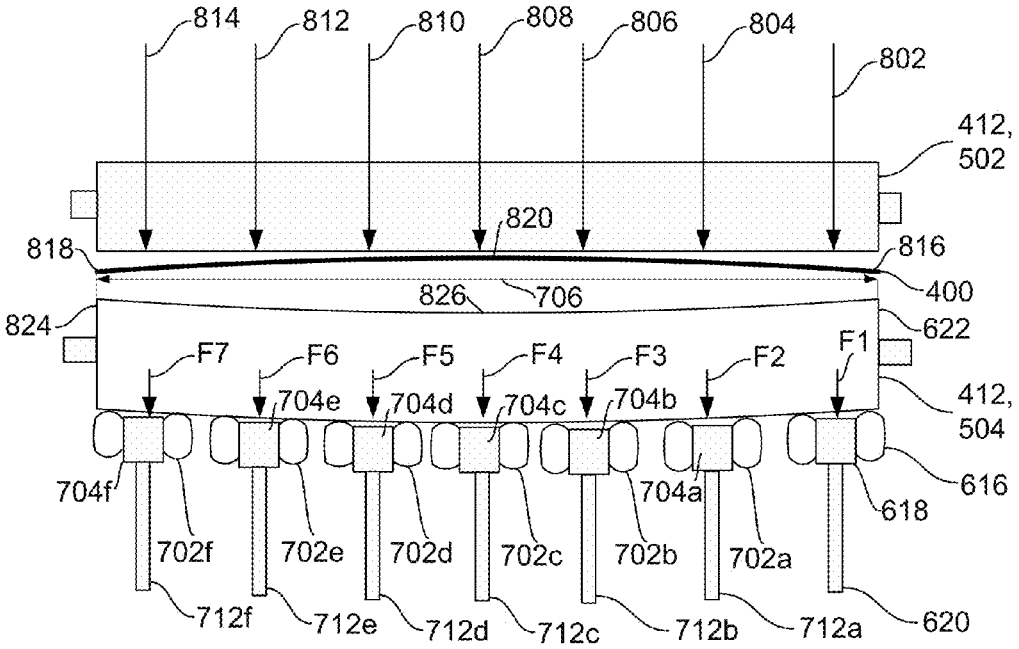
FIG. 8 is a side view of the example strip material positioned between two work rolls of the example leveler of FIGS. 4-7.

FIG. 8 is a diagrammatic view showing an example adjustment of the lower work rolls 504 relative to the upper work rolls 502 at the entry 630 of the leveler 402. For purposes of clarity, only two work rolls 412 are shown of each of the flights 618 and 704*a-f*. In the illustrated example, the work rolls 502 and 504 have lengths that traverse the width W of the strip material 400.

As the strip material 400 passes through the work rolls, the strip material 400 imparts a force to the work rolls 412. In the illustrated example, the strip material 400 may impart respective forces F1-F7 to the work rolls 412 that may be sensed or detected by a control fluid in the respective actuators 620 and 712*a-f* associated with respective zones 802-814. In some examples, the work roll 412, 504 defines a plurality of zones 802-814 across the width W of the strip material 400. In particular, the force imparted to the work roll 412 may be caused by a varying coil set effect in the strip material 400 between a leading edge (e.g., the leading edge 110) and a trailing edge (e.g., the trailing edge 112) of the strip material 400. Therefore, the respective forces F1-F7 may vary depending on, for example, the hardness of the strip material 400 across its width 706 and/or its length. Thus, the forces F1-F7 may be substantially similar and/or may vary as the strip material 400 moves through the leveler 402.

The adjustable flights 618 and 704*a-f* can be positioned independently relative to each other. As shown in FIG. 8, the adjustable flights 618 and 704*a-f* of the illustrated example enable the bottom backup bearings 616 and/or 702*a-f* to be adjusted independently (e.g., at different or the same heights or plunge depths) across the width 706 of the strip material 400. As shown, each of the adjustable flights 618 and 704*a-f* may represent one of the zones 802-814 across the width 706 of the strip material 400. In some examples, each of the zones 802-814 can be positioned to a plunge depth independently from a plunge depth of another one of the adjacent zones 802-814. For example, the regions or zones 802-814 may correspond to, for example, peripheral or outer edges (e.g., zones 802 and 814), mid-edges (e.g., zones 804, 806, 810 and 812) and a center portion (e.g., zone 808) of the strip material 400. The adjustable flights 618 and 712*a-f* of the illustrated example may be configured to correspond to respective ones of the zones 802-814. For example, the first backup bearing 616 is configured to engage the work roll 504 at the first zone 802 (e.g., via the first adjustable flight 618), and the second backup bearing 702*a* is configured to engage the work roll 504 at the second zone 804 (e.g., via the second adjustable flight 712*a*).

Figure 9:
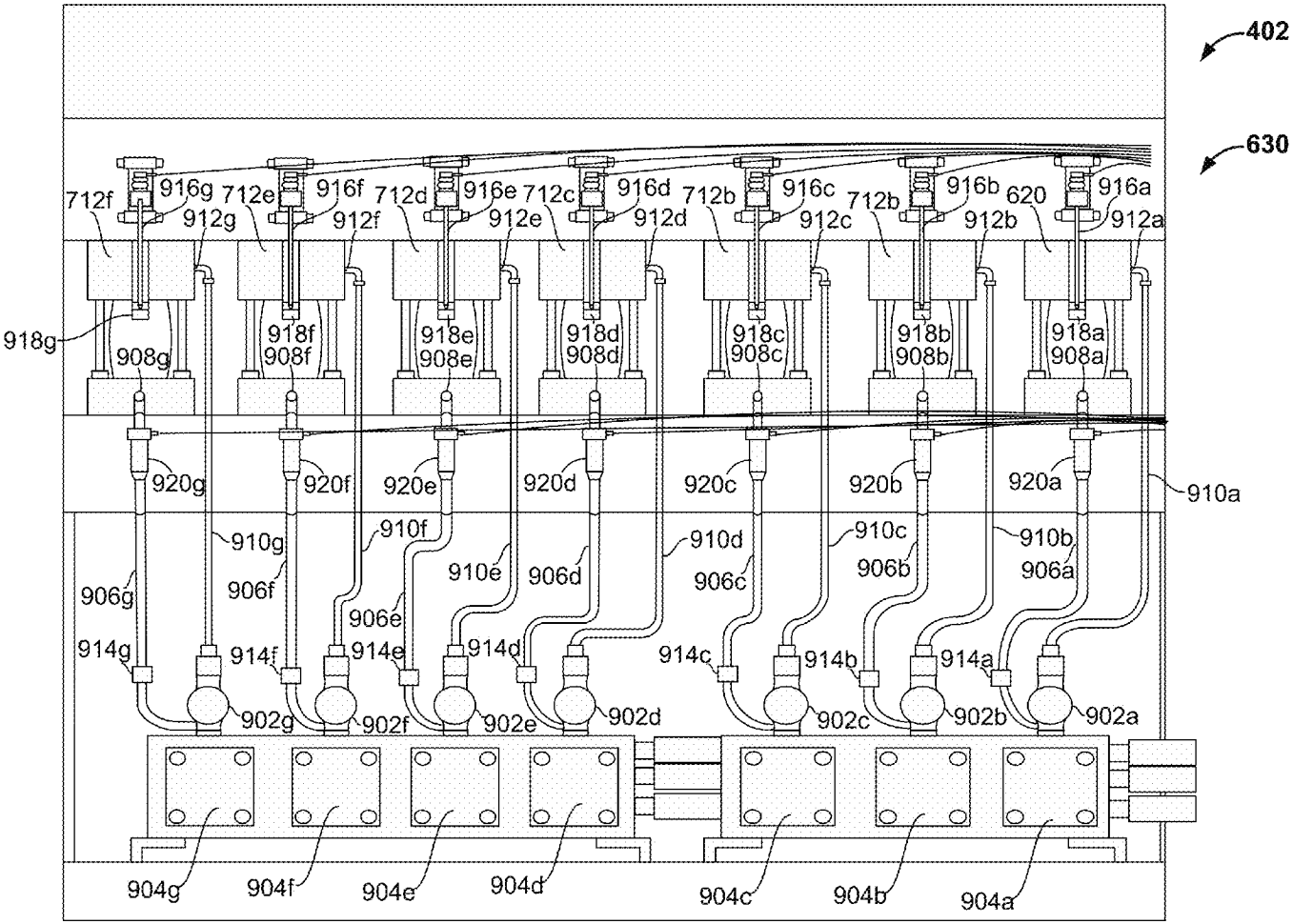
FIG. 9 is a front view of the example leveler of FIGS. 4-8.

FIG. 9 is a front view illustrating the entry 630 of the example leveler 402 of FIGS. 1-8. As shown in FIG. 9, each of the actuators 620 and 712*a-f* includes a pump 902*a-g* (e.g., hydraulic pumps such as gear pumps, rotary vane pumps, etc.) to operate (e.g., move) the respective ones of the actuators 620 and 712*a-f*. To move each of the actuators 620 and 712*a-f*, each pump 902 *a-g* provides a control fluid (e.g., a pressurized fluid such as a hydraulic fluid or oil) from a respective reservoir 904 *a-g* to the respective actuators 620 and 712*a-f*. Each pump 902 *a-g* includes a respective first fluid line 906 (e.g., a hydraulic hose, pipe, or other conduit) to fluidly couple the control fluid to respective first chambers 908*a-g* of the actuators 620 and 712*a-f* and a respective second fluid line 910*a-g* (e.g., a hose) to fluidly couple the control fluid to respective second chambers 912*a-g* of the actuators 620 and 712*a-f*. The leveler 402 of the illustrated example employs positioning valves 914 *a-g* (e.g., shut-off valves) that move between an open position to allow the control fluid to flow between the respective reservoirs 904*a-g* and the respective actuators 620 and 712*a-f* and a closed position to prevent fluid flow between the respective reservoirs 904*a-g* and the respective actuators 620 and 712*a-f*. For example, to move the first end 626 of the adjustable flight 618 toward the upper backup bearings 610 (e.g., increase a plunge force), a control fluid is supplied to the first chamber 908*a* of the actuator 620 via the first fluid line 906*a*. To move the first end 626 of the adjustable flight 618 away from the upper backup bearings 610 (e.g., to decrease a plunge force), the control fluid is provided to the second chamber 912*a* of the actuator 620 via the second fluid line 910*a*.

The position or location (e.g., the plunge) of each of the respective backup bearings 616 and 702*a-f* relative to the upper work rolls 502 may be sensed or detected by a respective position sensor 916*a-g* (e.g., a transducer). The position sensors 916*a-g* may include linear voltage displacement transformers (LVDTs) or any other suitable position sensing device or combination of devices. In the illustrated example, each of the actuators 620 and 712*a-f* employs a respective one of the position sensors 916*a-g* to detect a position of a respective arm or bracket 918*a-g* movably attached to the actuators 620 and 712*f*. For example, each bracket 918*a-g* moves with a piston (not shown) of a respective one of the actuators 620 and 712*a-f* as the actuators 620 and 712*a-f* move between a first position (e.g., a zero stroke position) and a second position (e.g., a 100% stroke position). By detecting the position of the actuators 620 and 712*a-f*, the position sensors 916*a-g* can provide an indication or correlation of a plunge depth between the upper work rolls 502 and the lower work rolls 504 (or the work rolls 412) for a corresponding zone (e.g., zones 802-814) associated with the respective ones of the actuators 620 and 702*a-f*. In other examples, position transducers, strain gauges, and/or any other suitable position sensors may be employed to detect the plunge depth position of the work rolls 412.

Further, a plurality of respective pressure sensors 920*a-g* are coupled to respective ones of the actuators 620, 622, 712*a-f* and 714*a-f* to detect or sense pressure changes in the actuators 620, 622, 712*a-f* and 714*a-f* caused by forces imparted to the work rolls 412 by the strip material 400 as the strip material 400 is processed by the work rolls 412. For example, a change in pressure in the actuators 620, 622, 712*a-f* or 714*a-f* may be caused by a deviation in a plunge depth position of the work rolls 412 due to the strip material 400 imparting forces to the work rolls 412. To sense a pressure in the actuators 620 and 712*a-f* (and/or the actuators 622, 714*a-f*), pressure sensors 920*a-g* may be fluidly coupled between the respective pumps 902*a-g* and the actuators 620 and 702*a-f*. As shown, the pressure sensors 920*a-g* are fluidly coupled to the first fluid lines 904*a-g* of each of the actuators 620 and 712*a-f*. For example, when a particular plunge depth is provided to the work rolls 412, the pressure sensors 920*a-g* detect the pressure (e.g., the pressure of the control fluid) in the respective actuators 620 and 714*a-f*. Further, when a plunge depth of the work rolls 412 is positioned, the positioning valve 914*a-g* associated with a particular actuator 620 and 712*a-f* in which the plunge depth is set is moved to a closed position. As a result, any deviation (e.g., a slight deviation or movement) in the position of the work roll 412 will affect (e.g., increase) the pressure of the control fluid in the respective actuator 620 and 712*a-f*. In addition, because an area of a piston in each of the actuators 620 and 712*a-f* is known, and the volume capacity of a cylinder of each of the actuators 620 and 712*a-f* is known, a force imparted to the work rolls 412 by the strip material 400 can be determined by sensing the pressure of the control fluid in the respective actuators 620 and 712*a-f*. In other examples, load cells may be used instead of the pressure sensors 920*a-g*. For example, a load cell may be positioned under each of the actuators 620 and 712*a-f* to detect a force (e.g., a vertical or reactive force) imparted to the work rolls 412 associated with the respective actuators 620 and 712*a-f*. In other examples, other pressure sensors, transducers, etc. may be employed that provide an electrical signal related to a magnitude of an applied pressure or force in the actuators 620 and 712*a-f*.

In some examples, only one pump 902*a*, one fluid reservoir 904*a*, one valve 914*a*, and/or one pressure sensor 920*a* may be employed to provide fluid to the first changes 908*a-g* and the second chambers 912*a-g* of the actuators 620, 712*a-f* and/or 622, 714*a-f*. For example, in some such examples, the plurality of lines 906*a-g* and 910*a-g* may fluidly communicate the pump 902*a* and the respective first chambers 908*a-g* and second chambers 912*a-g*. In some such examples, only one actuator 620 may be provided to adjust the upper work rolls 502 and the lower work rolls 504. In some examples, each of the respective first changes 908*a-g* may be coupled to a respective or dedicated pump (e.g., pumps 902*a-g*), and each of the respective second changes 912*a-g* may be coupled to a dedicated pump.

Figure 10:
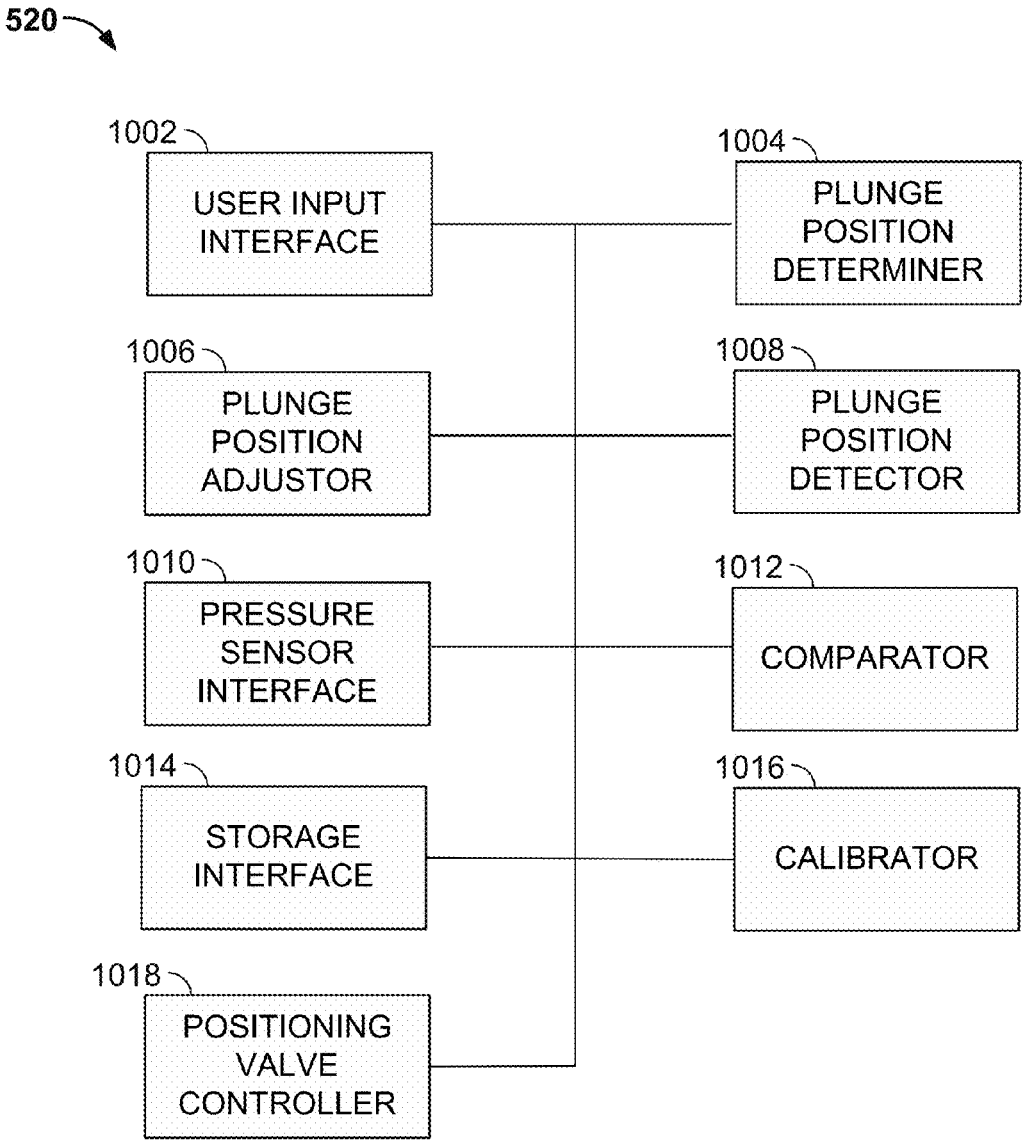
FIG. 10 illustrates an example controller that may be used to operate the example leveler of FIGS. 4-9.

FIG. 10 is a block diagram of the example controller 520 of FIG. 5 for automatically determining a plunge depth required to impart a stress to the strip material 400 associated with or approximate a yield strength or yield point (e.g., an actual yield point) of the strip material 400. In particular, the example controller 520 may be used in connection with and/or may be used to implement the example leveler 402 of FIG. 1-9 or portions thereof to adjust a plunge depth of the work rolls 412 based on a sensed pressure in any one of the actuators 620 and 712*a-f* and/or the actuators 622 and 714*a-f* (e.g., the entry work rolls 506 associated with a corresponding zone 802-814, the exit work rolls 508). In some examples, the example controller 520 may also be used to implement a feedback process to adjust a plunge depth (e.g., the plunge depth position 512 and/or 518 of FIG. 5) of the entry and/or exit work rolls 506 and 508 (FIG. 5) to condition the strip material 400 based on the pressures sensed by the respective pressure sensors 920*a-g*, for example, in each of the zones 802-814.

As shown in FIG. 10, the example controller 520 includes a user input interface 1002, a plunge position determiner 1004, a plunge position adjustor 1006, a plunge position detector 1008, a pressure sensor interface 1010, a comparator 1012, a storage interface 1014, a calibrator 1016, and a positioning valve controller 1018, all of which may be communicatively coupled as shown or in any other suitable manner.

The user input interface 1002 may be configured to determine strip material characteristics. For example, the user input interface 1002 may be implemented using a mechanical and/or graphical user interface via which an operator can input the strip material characteristics. The material characteristics can include, for example, a thickness of the strip material 400 (e.g., thickness $T_1$ of FIG. 5), a width of the strip material 400, the type of material (e.g., aluminum, steel, etc.), Young's modulus of elasticity, etc. In some examples, the storage interface 1014 can retrieve information (e.g., Young's modulus of elasticity) from a reference table or data structure for different material type(s) based on material information received by the input interface 1002. The user input interface 1002 may be configured to communicate the strip material characteristics to the plunge position determiner 1004.

The plunge position determiner 1004 of the illustrated example determines a plunge depth based on the material characteristics received by the input interface 1002. In particular, the example plunge position determiner 1004 determines or calculates a plunge depth that provides a plunge force or stress to the strip material 400 that is within a threshold (e.g., three percent) of an actual yield point of the strip material 400. In particular, the plunge position determiner 1004 determines or identifies a plunge depth position during a set-up operation prior to processing the strip material 400.

To determine a plunge depth associated with an actual yield strength of the strip material 400, the plunge position determiner 1004 causes the plunge position adjustor 1006 to incrementally adjust a plunge depth of the work rolls 412 (e.g., the entry work rolls 506) between an initial position and a final position. Incrementally increasing the plunge depth results in a distance (e.g., the distance d1 of FIG. 5) between the upper work rolls 502 and the lower work rolls 504 that decreases. The plunge position determiner 1004 may increase the plunge depth by a preset or predetermined incremental value (e.g., a value of approximately 0.002 inches). Using a smaller incremental value (e.g., 0.001 or 0.0005 inches) increases the accuracy of identifying a plunge depth that imparts a stress to the strip material 400 at the actual yield strength or point of the strip material 400.

In some examples, to determine the initial value, the plunge position determiner 1004 may retrieve an initial plunge depth value and/or a final plunge depth value from the user interface 1002 (e.g., provided by an operator). Thus, the initial and/or final plunge depth value can be provided by an operator during, for example, a set-up operation.

In some examples, the plunge position determiner 1004 may determine the initial plunge position and/or the final plunge depth position from a reference table stored in the storage interface 1014. For example, the plunge position determiner 1004 may determine the initial plunge position and/or the final plunge depth position from a reference table based on the material characteristics received via the user input interface 1002 (e.g., Young's modulus of elasticity, material type, the grade of material, etc.). Thus, the initial plunge depth and/or the final plunge depth can be determined from a reference table based on, for example, empirical data and/or estimates based on the type(s) of material being plunged. For example, in some such examples, the plunge position determiner 1004 determines the initial plunge value and/or the final plunge value based on a range of yield strengths provided by a particular grade of the strip material (e.g., Grade A particular grade of steel). The plunge position determiner 1004 sets the initial plunge position based on a lowest yield strength of the range and sets the final plunge position based on a highest yield strength of the range. For example, grade A36 steel has a yield strength range between approximately 30,000 and 45,000 pounds/in$^2$ (psi). Thus, the plunge position determiner 1004 may determine the initial plunge position based on the yield strength of 30,000 psi (e.g., or a value or buffer less than 30,000 psi (e.g., 25,000 psi)) and may determine the final plunge position based on the yield strength of 45,000 psi (e.g., or a value or buffer greater than 45,000 psi (e.g., 50,000 psi)).

In some examples, the plunge position determiner 1004 determines the final plunge position based on the output of pressure readings provided by the pressure sensor interface 1010. For example, the plunge position determiner 1004 may determine an increase in consecutive pressure readings and then detects a drop in pressure readings. After detection of the drop, a final plunge position value may be determined when the pressure readings provided by the pressure sensor interface 1010 provide a pattern such as three consecutive increases in pressure after detection of a drop in pressure. The plunge position determiner 1004 may determine the final plunge position value corresponding to the third consecutive pressure increase reading.

In some examples, the plunge position determiner 1004 may employ one or more of, and/or any combination of, user input information, reference table information and/or pressure reading information to determine the initial plunge depth value or position and/or the final plunge depth value or position.

To adjust the plunge depth of the work rolls 412 incrementally (e.g., the entry work rolls 506 in each of the different zones 802-814), the plunge position adjustor 1006 causes the pumps 902*a-g* to supply the control fluid to the respective actuators 620, 622, 712*a-f* and 714*a-f*. For example, to adjust the plunge depth positions of the entry work rolls 506, the plunge depth determiner 1004 may command the plunge position adjustor 1006 to initiate one or more of the pumps 902*a-g* to supply pressurized control fluid from one or more of the reservoirs 904 *a-g* to one or more of the respective chambers 908*a-g* and/or 912*a-g* of the actuators 620 and 712*a-f*. The plunge position adjustor 1006 may command one or more of the pumps 902*a-g* to deliver pressurized control fluid sufficient to position the respective adjustable flights 618 and 704*a-f* and, thus, the backup bearings 616 and 702*a-f* relative to the upper work rolls 502 to provide desired plunge depths (e.g., incremental plunge depths) determined or calculated by the plunge position determiner 1004. For example, the plunge position adjustor 1006 may adjust the position (e.g., the stroke position) of the actuators 620 and 712*a-f* until the plunge position detector 1008 determines that the respective actuators 620 and 712*a-f* are at the desired position (e.g., a stroke position) corresponding to a desired plunge depth of the work rolls 412.

The plunge position detector 1008 may be configured to sense or detect the incremental plunge depth position values of the work rolls 412. For example, the plunge position detector 1008 can detect the vertical position or distance between the work rolls 412 (i.e., the upper work rolls 502 and the lower work rolls 504) to achieve a particular plunge depth position 512 (e.g., the distance ($d_1$) between the upper work rolls 502 and the lower work rolls 054 of FIG. 5). To detect the position of the plunge depth, the plunge position detector 1008 receives a position signal value from the position sensors 916*a-g* of FIG. 9. For example, the positions sensors 916*a-g* provide a signal to the plunge position detector 1008 based on the position of the respective brackets 918*a-g*, which correlate to the stroke position of the respective actuators 620 or 712*a-f*. The plunge position detector 1008 can then communicate the plunge depth position value to the plunge position determiner 1004, the plunge position adjustor 1006 and/or the comparator 1012.

The positioning valve controller 1018 is configured to prevent or restrict control fluid from flowing between the reservoirs 904*a-g* and the respective actuators 620 and 712*a-f*. For example, after the plunge depth positions of the work roll 412 in of the zones 802-814 are positioned, the positioning valve controller 1018 may cause each of the positioning valves 914*a-g* to move to a closed position. With the positioning valve 914*a-g* in the closed position, a volume of control fluid in each of the respective actuators 620 and 712*a-f* is known and/or controlled.

The pressure sensor interface 1010 can be configured to obtain the pressure value, for example, of the control fluid in the actuators 620, 622, 712*a-f* and 714*a-f*. For example, the pressure sensor interface 1010 may be configured to obtain pressure values at each of the incrementally adjusted plunge depth positions for each of the actuators 620, 622, 712*a-f* and 714*a-f*. In some examples, the pressure sensor interface 1010 obtains the pressure values at each incrementally adjusted plunge positions after a predetermined time delay (e.g., between approximately 1 second and 10 seconds). The pressure sensor interface 1010 may be communicatively coupled to one or more pressure sensors or pressure measurement devices such as, for example, the pressure sensors 920*a-g* of FIG. 9. For example, the pressure sensors 920*a-g* may provide signals (e.g., electric signals) to the pressure sensor interface 1010, which correlate to pressures of the control fluid in the respective actuators 620 and 712*a-f*.

In some examples, the pressure sensor interface 1010 may receive pressure measurement values from the pressure sensor 920*d* associated with the actuator 712*c* (e.g., a central actuator) at the entry of the leveler 402 (e.g., only from the actuator 712*c*).

The comparator 1012 may be configured to receive the pressure measurement values from the pressure sensor interface 1010 for each of the incremental plunge depths of each of the actuators 620, 622, 712*a-f* and 714*a-f*. For example, the comparator 1012 may receive the pressure measurement values for each of the respective incremental plunge depths associated with the actuator 712*c*. The comparator 1012 may be configured to perform comparisons of the pressure measurement values provided by the pressure sensor 920*d* associated with the actuator 712*c*. The comparator 1012 may be configured can determine a lowest or smallest pressure reading and identify the incremental plunge depth value of the entry work rolls corresponding to the detected smallest pressure reading. More specifically, the lowest or smallest pressure reading detected is associated with or corresponds to the hook 202 of the graph 200 of FIG. 2. In particular, the lowest or smallest detected pressure measurement value approximates the yield point of the strip material 400 within a threshold (e.g., about 3 percent). In this manner, the detected smallest pressure measurement value associated with the incremental plunge depth position is approximately equal to the yield point of the strip material 400. The smaller the incremental values, the measured pressure measurement values approximate the actual yield point (e.g., the yield point 202) associated with the strip material 400. Thus, the plunge position determiner 1004 detects a plunge depth (e.g., the incremental plunge depth position associated with the smallest pressure reading) that imparts a stress to the strip material 400 that is approximate to an actual yield point (e.g., the yield point 202 of the graph 200 of FIG. 2).

In turn, the plunge position determiner 1004 causes the plunge position adjustor 1006 to adjust or set a plunge depth or vertical positions of the entry work rolls 506 to the calculated or identified work roll plunge depth (e.g., the plunge depth $d_1$ of FIG. 5). In some examples, the plunge depth determiner 1004 causes the plunge position adjustor 1006 to adjust a plunge depth (e.g., the plunge depth $d_2$ of FIG. 5) of the exit work rolls 508 based on the particular strip material data (e.g., the thickness T1 of the strip material 400) provided by the user via the user input interface 1002. For example, the plunge of the exit work rolls 308 may be set so that a separation gap between opposing surfaces of the upper and lower work rolls is substantially equal to the thickness of the strip material 400). Thus, the entry work rolls 506 may be adjusted to provide a plunge depth that is deeper (e.g., greater) than the plunge depth of the exit work rolls 508 (e.g., $d_1$ of FIG. 5 is less than $d_2$ of FIG. 5).

Additionally or alternatively, in some examples, the pressure measured values may be provided from each of the actuators 620, 622, 712*a-f* and 714*a-f* and/or the zones 802-814. In some such examples, the pressure sensor interface 1010 may receive pressure measurement values from each pressure sensor 920*a-g* associated with the respective actuators 620, 622, 712*a-f* and 714*a-f*. The pressure sensor interface 1010 may be configured to then send the pressure measurement values to the plunge position determiner 1004 and/or the comparator 1012. The comparator 1012 may be configured to detect the smallest pressure reading and the associated incremental plunge depth position for each of the actuators 620 and 712*a-f*. In some examples, the plunge position determiner 1004 causes the plunge position adjustor 1006 to adjust each of the actuators 620 and 712*a-f* to their respective identified incremental plunge depth position associated with the detected smallest pressure reading of the respective actuator 620 and 712*a-f*. In some such examples, the plunge position determiner 1004 causes the plunge position adjustor 1006 to adjust the plunge depths (e.g., the plunge depth distance d1 of FIG. 5) of each of the actuators 620 and 712*a-f* to their respective incremental plunge depth values corresponding to the smallest pressure measure measurement value of the particular actuator 620 and 712*a-f*. In some examples, the comparator may determine an average value of the incremental plunge depth value associated with the smallest pressure measurement values in each of the actuators 620 and 712*a-f*. In some such examples, the plunge position determiner 1004 causes the plunge position adjustor 1006 to adjust the plunge depths (e.g., the plunge depth distance d1 of FIG. 5) of each of the actuators 620 and 712*a-f* to the determined average incremental plunge depth position to process the strip material 400.

Figure 14:
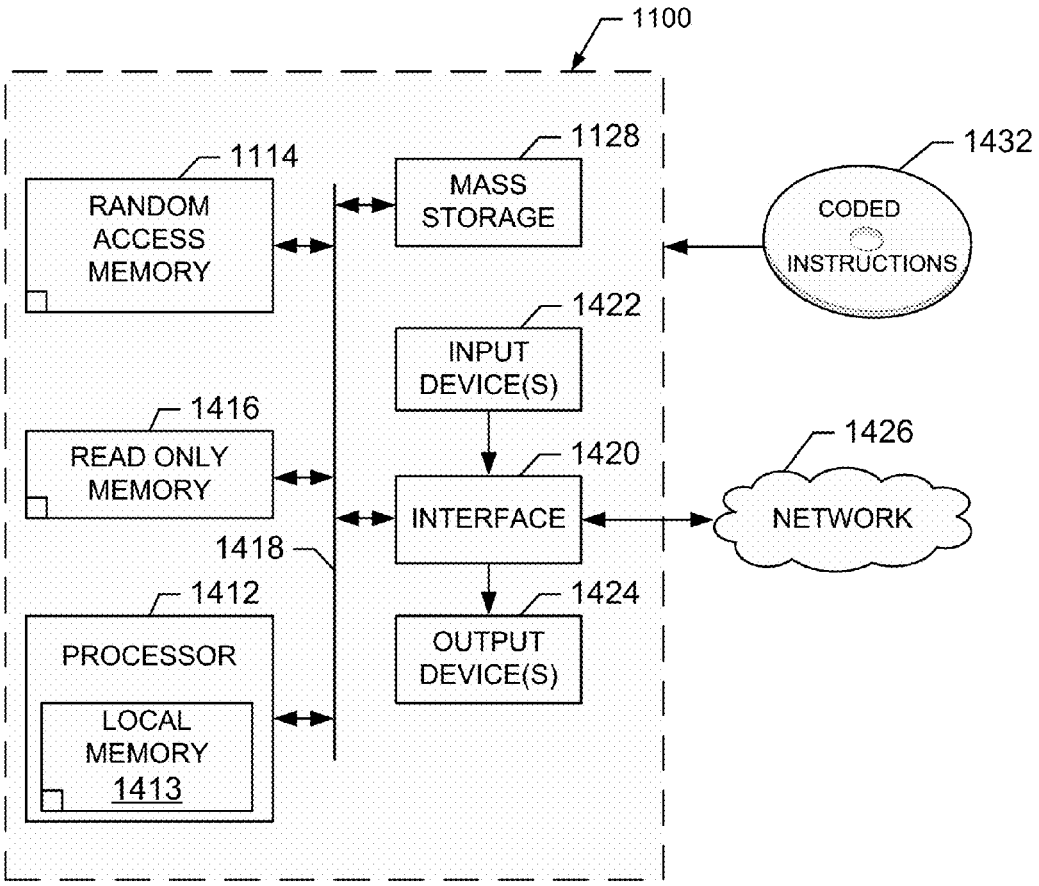
FIG. 14 is a block diagram of an example processor system that may be used to implement the example methods and apparatus described herein.

The storage interface 1014 may be configured to store data values (e.g., the incremental plunge depth value, the initial plunge depth value, the final plunge depth value, the pressure measurement values, the smallest detected pressure measurement value, etc.) in a memory such as, for example, the system memory 1413 and/or the mass storage memory 1428 of FIG. 14. Additionally, the storage interface 1014 may be configured to retrieve data values from the memory (e.g., the incremental plunge depth values, the pressure measurement values, etc.). For example, the storage interface 1014 may be configured to store data values associated with a particular type of strip material and/or material characteristics received by the user input interface 1002. For example, the storage interface 1014 may store an initial plunge value and a maximum plunge value for a particular grade of steel of a strip material. For example, grade A36 steel may have a yield strength range between approximately 30,000 and 45,000 pounds/in$^2$ (psi). In such example, a first or initial plunge depth may be associated with the 30,000 psi yield strength and a second or maximum plunge depth may be associated with the 45,000 psi yield strength.

The calibrator 1016 may be configured to calibrate the position sensors 916*a-g* and/or the pressure sensors 920*a-g* of the example leveler 402. For example, the calibrator 1016 may initiate a calibration of the sensors 916*a-g* and/or 920*a-g* prior to processing the strip material 400 through the leveler 402. The calibrator 1016 may be configured to initiate when a user input command is selected via the user input interface 1002. Additionally or alternatively, the calibrator 1016 may be configured to automatically initiate calibration of the positioning sensors 916*a-g* and/or the pressure sensors 920*a-g* prior to beginning a production run to condition the strip material 400.

The calibrator 1016 may be configured to command and/or communicate with the plunge position detector 1008 and/or the pressure sensor interface 1010. To calibrate the position sensors 916*a-g* and/or the pressure sensors 920*a-g*, the calibrator 1016 may be configured to command the plunge position adjustor 1006 to move the work rolls 412 to a closed position. For example, the work rolls 412 may be in a closed position when the lower work rolls 504 engage the upper work rolls 502 prior to the strip material 400 passing through the leveler 402. Alternatively, calibration plates having a known thickness may be positioned between the upper work rolls 502 and the lower work rolls 504 and the calibrator 1016 may instruct the plunge position adjustor

1006 to move the lower work rolls 504 toward the upper work rolls 502 until the upper work rolls 502 and the lower work rolls 504 engage or close against opposing surfaces of the calibration plates. For example, an operator may position the calibration plates between the upper work rolls 502 and the lower work rolls 504.

Once the upper work rolls 502 and the lower work rolls 504 are in a closed position, the calibrator 1016 may be configured to determine and/or record the measured position values provided by the position sensors 916*a-g* for each of the actuators 620, 622, 712*a-f* and 714*a-f* and/or zones 802-814 and/or the plunge position pressure values provided by the pressure sensors 920*a-g* for each of the actuators 620, 622, 712*a-f* and 714*a-f* and/or zones 802-814. For example, because the thickness of the calibration plates is known, position signals provided by the position sensors 916*a-g* can correlate to respective plunge depth position values that correspond to respective stroke positions of the actuators 620, 622, 712*a-f* and 714*a-f* and/or zones 802-814. Additionally, the pressure values sensed by the pressure sensors 920*a-g* may correlate to a force (e.g., a vertical force) imparted to the strip material 400 by the work rolls 412 associated with the respective actuators 620, 622, 712*a-f* and 714*a-f* and/or zones 802-814 when the respective actuators 620, 622, 712*a-f* and 714*a-f* and/or zones 802-814 are positioned to the plunge depth positions. After the sensors 916*a-g* and/or 920*a-g* are calibrated, the calibrator 1016 may communicate to the plunge depth determiner 1004 that the calibration is complete.

While an example manner of implementing the controller 520 is illustrated in FIG. 10, one or more of the elements, processes and/or devices illustrated in FIG. 10 may be combined, divided, re-arranged, omitted, eliminated and/or implemented in any other way. Further, the example user input interface 1002, the example plunge depth determiner 1004, the plunge position adjustor 1006, the example plunge position detector 1008, the example pressure sensor interface 1010, the example comparator 1012, the example storage interface 1014, the example calibrator 1016 and/or the example positioning valve controller 1018 and/or, more generally, the example controller 520 of FIG. 10 may be implemented by hardware, software, firmware and/or any combination of hardware, software and/or firmware. Thus, for example, any of the example user input interface 1002, the example plunge depth determiner 1004, the plunge position adjustor 1006, the example plunge position detector 1008, the example pressure sensor interface 1010, the example comparator 1012, the example storage interface 1014, the example calibrator 1016 and/or the example positioning valve controller 1018 and/or, more generally, the example controller 520 of FIG. 10 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example, the example user input interface 1002, the example plunge depth determiner 1004, the plunge position adjustor 1006, the example plunge position detector 1008, the example pressure sensor interface 1010, the example comparator 1012, the example storage interface 1014, the example calibrator 1016 and/or the example positioning valve controller 1018 and/or, more generally, the example controller 520 of FIG. 10 is/are hereby expressly defined to include a tangible computer readable storage device or storage disk such as a memory, a digital versatile disk (DVD), a compact disk (CD), a Blu-ray disk, etc. storing the software and/or firmware. Further still, the example controller 520 of FIG. 10 may include one or more elements, processes and/or devices in addition to, or instead of, those illustrated in FIG. 10, and/or may include more than one of any or all of the illustrated elements, processes and devices.

Figure 11:
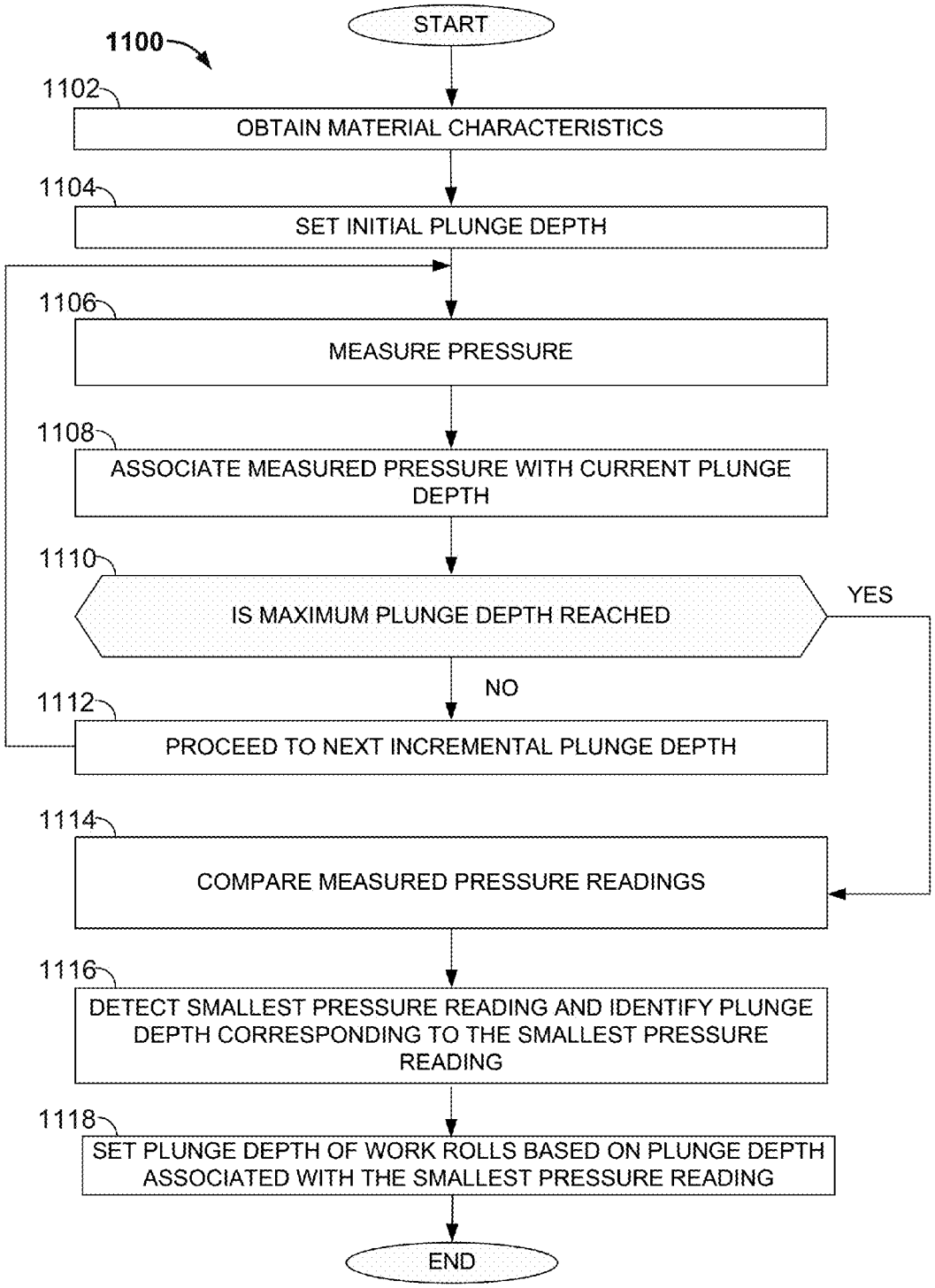
FIG. 11 is a flow diagram of an example method to implement an example plunge depth determiner of the example controller of FIG. 10.
Figure 13:
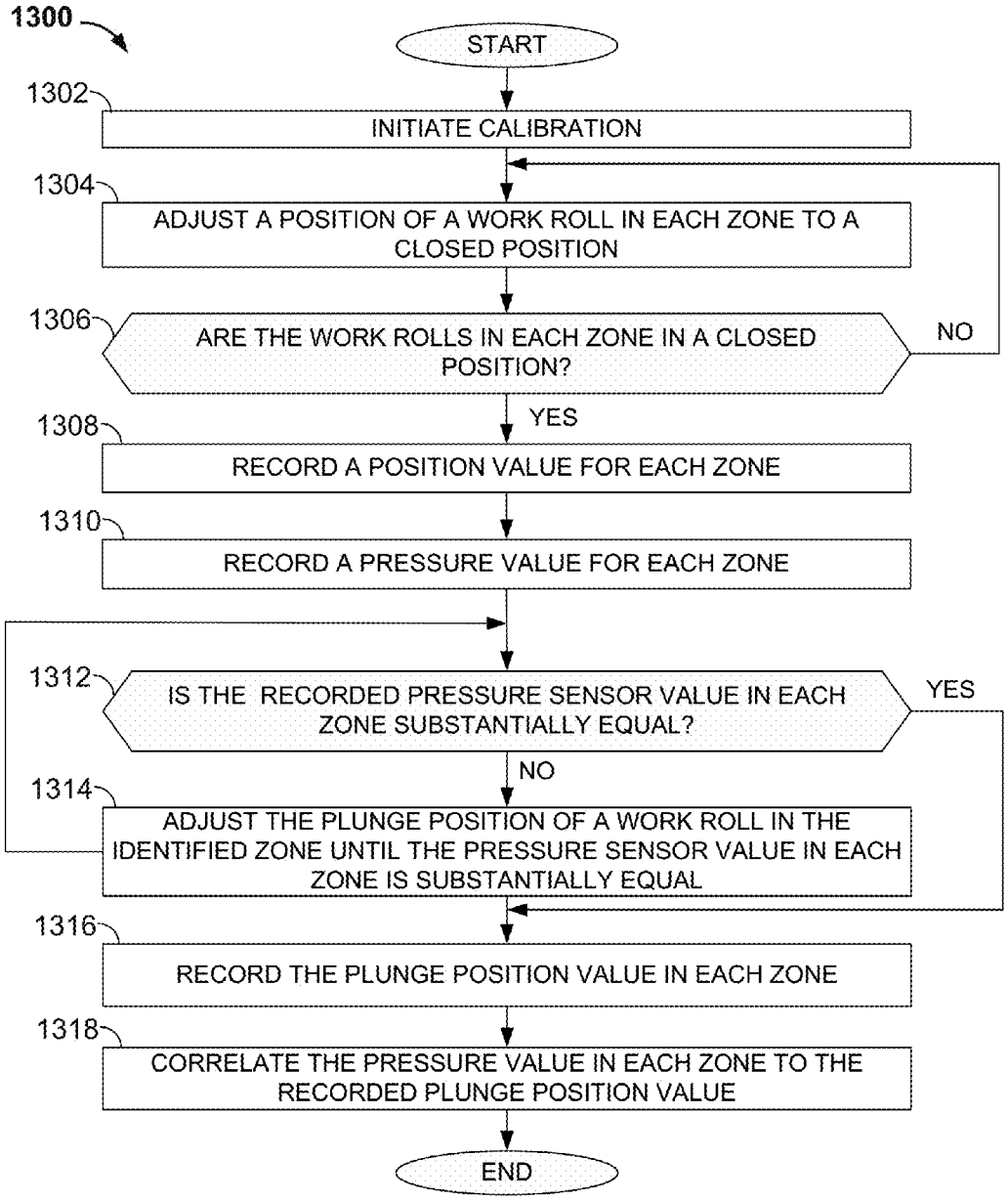
FIG. 13 is a flow diagram of an example method that may be used to calibrate one or more sensors of the example leveler of FIGS. 4-10.

FIG. 11 illustrates a flowchart representative of example machine readable instructions for implementing the controller 520 of FIGS. 5 and 10 and/or the plunge depth determiner 1104 of FIG. 10. FIG. 13 illustrates a flowchart representative of example machine readable instructions for implementing the controller 520 of FIGS. 5 and 10 and/or the calibrator 1016 of FIG. 10. In this example, the machine readable instructions comprise a program for execution by a processor such as the processor 1412 shown in the example processor platform 1400 discussed below in connection with FIG. 14. The program may be embodied in software stored on a tangible computer readable storage medium such as a CD-ROM, a floppy disk, a hard drive, a digital versatile disk (DVD), a Blu-ray disk, or a memory associated with the processor 1412, but the entire program and/or parts thereof could alternatively be executed by a device other than the processor 1412 and/or embodied in firmware or dedicated hardware. Further, although the example programs are described with reference to the flowcharts illustrated in FIGS. 11 and 13, many other methods of implementing the example controller 520, the example plunge depth determiner 1004 and/or the calibrator 1016 may alternatively be used. For example, the order of execution of the blocks may be changed, and/or some of the blocks described may be changed, eliminated, or combined.

As mentioned above, the example processes of FIGS. 11 and 13 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example processes of FIGS. 11 and 13 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

Turning in detail to FIG. 11, the plunge position determiner 1004 receives or obtains strip material characteristics information (block 1102). For example, a user can input the material characteristics via a controller user interface such as, for example, the user input interface 1002 of FIG. 10.

The plunge depth determiner 1004 instructs or causes the plunge depth adjustor to move the work rolls 412 to an initial plunge depth (block 1104). For example, the plunge position adjustor 1006 commands one or more of the pumps 902*a-g* to deliver pressurized control fluid to one or more of the respective actuators 620, 622, 712*a-f* and 714*a-f*. More specifically, as noted above, the plunge position adjustor 1006 adjusts the plunge position of the work rolls 412 at the entry 630 of the leveler 402 (e.g., the plunge depth distance $d_1$ at the entry work rolls 506) and the plunge position of the work rolls 412 at the exit 632 of the leveler 402 (e.g., the exit work rolls 508). The work rolls 412 at the exit 632 may be set to a plunge depth that is equal to a thickness (e.g., the thickness $T_1$) of the strip material 100 received via the user input interface 1002. In some examples, the plunge position determiner 1004 retrieves the initial plunge depth value via the user input interface 1002. In some examples, the initial plunge depth value is determined using a reference table retrieved from the storage interface 1014. For example, based on the material characteristics received from the input interface 1002, the plunge position determiner 1004 determines a plunge depth value associated with a minimum yield strength of the strip material.

After the initial plunge depth is set and prior to processing the strip material, a pressure value is measured (block 1106). For example, the pressure value may be a pressure provided by the pressure sensor 920*d* of the cylinder 712*c* when the work rolls 412 at the entry 630 are positioned at the initial plunge depth. For example, the pressure sensor interface 1010 may detect, via the pressure sensor 920*d*, a pressure value in the actuator 712*c* when the actuator 712*c* is positioned at a stroke position that correlates to the initial plunge depth position of the respective work rolls 412 associated with the actuator 712*c*. In some examples, the pressure sensor interface 1010 may measure the pressure in the actuator 712*c* after a predetermined time period has lapsed (e.g., three seconds, five seconds, etc.) from the time that the plunge position adjustor 1006 positions the work rolls 412 to the initial plunge depth position. In some examples, a pressure in each of the zones 804-814 associated with the cylinders 620 and 712*a-f* is recorded. For example, the pressure sensor interface 1010 may detect, via one or more of the pressure sensors 920*a-g*, a pressure value in each of the actuators 620, 712*a-f* and/or zones 802-814 when the actuators 620, 712*a-f* are at respective initial stroke positions that correlate to the initial plunge depth positions of the respective work rolls 412 associated with the actuators 620, 712*a-f*.

The plunge position determiner 1004 associates the measured pressure with the current plunge depth (block 1108). For example, at the initial plunge depth, the pressure sensor interface 1010 determiners the pressure in the cylinder 712*c* and associates the pressure value with the initial plunge depth position.

The plunge position determiner 1004 then determines if a maximum plunge depth has been reached (block 1110). For example, based on the material characteristics received from the input interface 1002, the plunge position determiner 1004 determines a maximum plunge depth value associated with a maximum yield strength of the strip material based on the material characteristics. For example, the plunge position determiner 1004 may retrieve a reference table from the storage interface 1014 providing a plunge depth associated with a maximum yield strength of the strip material. In some examples, a user or operator may input the maximum plunge depth value via the user input interface 1002. In some examples, the maximum plunge depth value is determined based on a comparison and/or a pattern of the output pressure sensor readings provided by the pressure sensor interface 1010. For example, the comparator 1012 compares a first pressure output and a second pressure output to detect consecutive increases in pressure. For example, if a pressure increase is detected between two consecutive values, the comparator 1012 compares a third pressure output with the second pressure output. The plunge position determiner 1004 causes the plunge depth adjustor 1006 to adjust the plunge by another incremental plunge depth. If the pressure decreases after the incremental plunge adjustment, the comparator 1012 compares the next subsequent pressure reading with the preceding pressure reading until a number (e.g., three) of consecutive pressure increases is detected. At the last pressure increase detected after the consecutive pressure increase threshold is met, the plunge position determiner 1004 stops sampling and the maximum plunge depth is determined. In some examples, the comparator 1012 compares the pressure outputs and after a second drop in pressure compared to a preceding pressure reading is detected, the comparator 1012 continues to monitor until a number of consecutive pressure increases is achieved. Once the number of consecutive pressure readings is detected, the maximum plunge depth is reached.

If a maximum plunge depth has not been reached at block 1110, the plunge position determiner 1004 proceeds to the next incremental plunge depth (block 1112). Specifically, the plunge position determiner 1004 causes the plunge position adjustor 1006 to increase a plunge depth by an incremental value. For example, the incremental value may be a five-thousandths of an inch (e.g., 0.0005 inches), ten-thousandths of an inch (0.001 inches), twenty-thousandths of an inch (0.0020) and/or any other incremental value. A smaller incremental value enables the plunge depth determiner 1004 to more accurately determine a plunge depth associated with an actual yield point of a strip material. For each incremental value, the pressure is measured (block 1106) and the measured pressure is associated with the current plunge depth (block 1108). As noted above, the pressure at each incremental plunge depth position may be measured after a predetermined period of time has lapsed (e.g., after three seconds).

When the maximum plunge depth is met at block 1110, the plunge depth determiner 1004 compares the measured pressure readings (block 1114). For example, each of the measured pressure readings associated with the various incremental plunge depths are compared via the comparator 1012.

The comparator 1012 and/or the plunge depth determiner 1004 detect or determine the smallest pressure reading and identifies the plunge depth corresponding to the smallest pressure reading (block 1116). The smallest pressure reading is associated with a plunge depth that imparts a stress to the strip material 400 that is closest (e.g., within three percent) of a yield point (e.g., of an actual yield point) of the strip material 400. For example, the stress or pressure determined by the plunge depth determiner 1004 is associated with the yield point 202 of the strip material 400 provided by the stress-strength curve of FIG. 2. In some examples, the plunge depth determiner 1004 measures the pressure of each of the cylinders 620 and 712*a-f* at each of the incremental plunge depths. The plunge depth determiner 1004 and/or the comparator 1012 determine the smallest pressure reading for each of the cylinders 620 and 712*a-f* and the associated plunge depths corresponding to the respective smallest pressure readings. The plunge depths of each of the cylinders 620 and 712*a-f* corresponding to the smallest pressure readings are identified and the controller 518 determines an average plunge depth value. The plunge adjustor 1006 adjusts the plunge depth of the entry work rolls 506 via the cylinders 620 and 712*a-f* to the determined average plunge depth value. In yet other examples, the plunge depth determiner 1004 determines the plunge depth of each of the different cylinders 620 and 712*a-f* and adjusts each of the cylinders 620 and 712*a-f* to the respective plunge depth corresponding to a smallest pressure reading. In this manner, each of the cylinders 620 and 712*a-f* are adjusted independently of each other to a plunge depth associated with their respective smallest pressure reading. In other words, in some such examples, the method 1100 of FIG. 11 is conducted for each cylinder 620 and 712*a-f* and independently of each other.

The plunge depth determiner 1004 and/or the plunge position adjustor 1006 adjusts the plunge depth of the work rolls 412 (e.g., at the entry work rolls) based on the identified plunge depth associated with the smallest pressure reading (block 1118). For example, the plunge depth determiner 1004 and/or the plunge position adjustor 1006 adjusts the plunge depth of the entry work rolls 506 via the cylinders 620 and 712*a-f* to the identified plunge depth corresponding to the smallest pressure reading. The plunge depth determiner 1004 and/or the plunge position adjustor 1006 positions the exit work rolls 508 corresponding to the thickness of the strip material (e.g., obtained via the user input interface 1002). For example, the plunge depth determiner 1004 and/or the plunge position adjustor 1006 adjusts the plunge depth of the exit work rolls 508 via the cylinders 622 and 714*a-f* to the identified plunge depth corresponding to the thickness of the strip material (e.g., a gap or vertical distance between a lowermost point of the upper work rolls and the uppermost point of the lower work rolls is substantially equal to the thickness of the strip material).

After the cylinders 620 and 712*a-f* are set at the identified plunge depth position and/or the cylinders 622 and 714*a-f* are set at the plunge depth corresponding to the thickness of the strip material, the strip material (e.g., the strip material 400) is processed. In operation, the strip material may be continuously fed to the leveler 402 from an uncoiler (e.g., the uncoiler 408 of FIG. 4).

Figure 12:
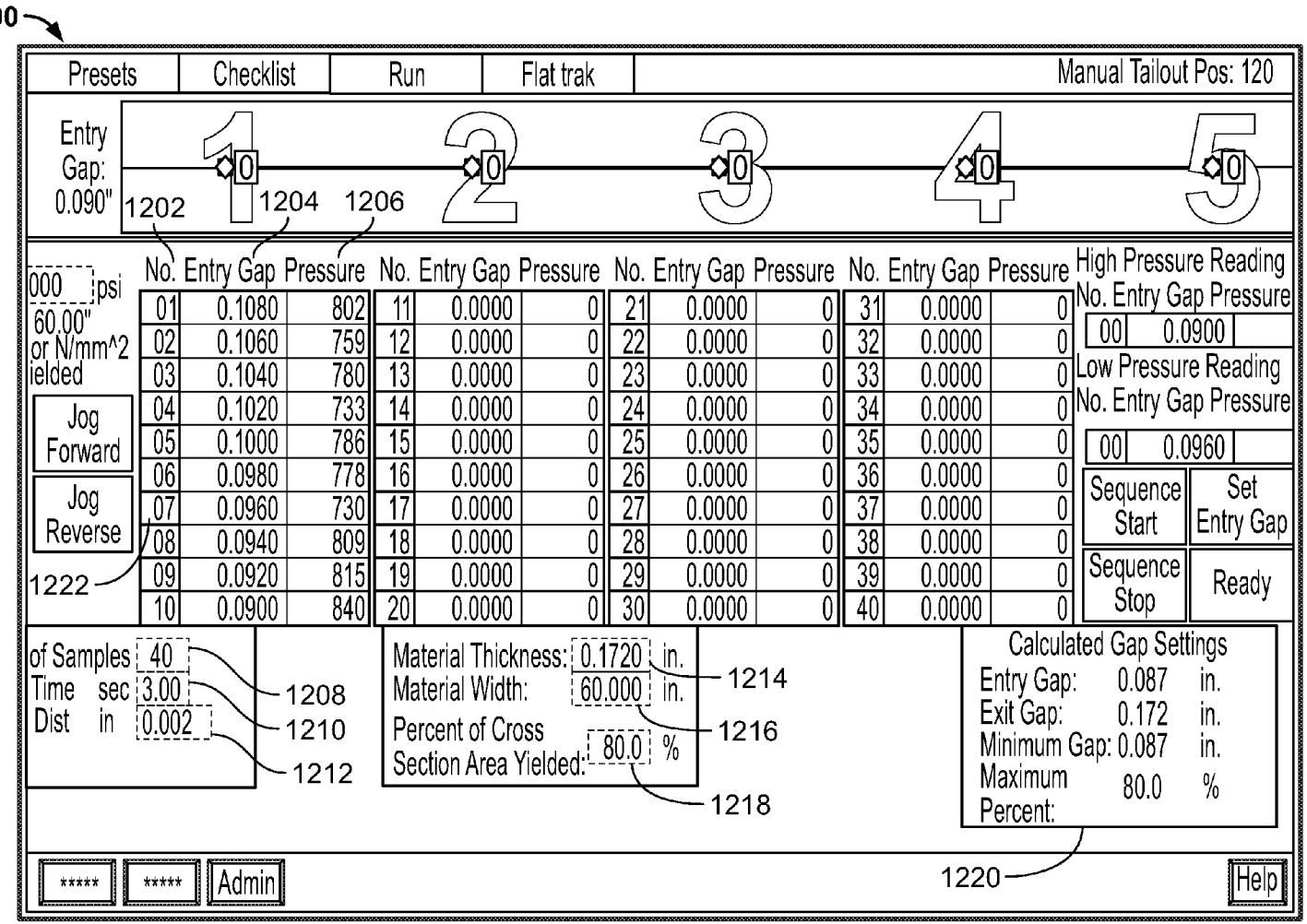
FIG. 12 illustrates an example display illustrating results of a strip material processed using the example plunge depth determiner of the example controller of FIG. 10 and the example method of FIG. 11.

FIG. 12 illustrates an example display or output 1200 provided by the plunge depth determiner 1004 when executing the example method 1100 of FIG. 11 to process an example strip material composed of steel. In particular, prior to processing the strip material, the plunge depth determiner 1004 determines a plunge depth approximate to a yield point (e.g., the yield point 202 of the stress-strain graph 200 of FIG. 2) of the strip material.

In the illustrated example, the strip material processed in the example of FIG. 12 is composed of carbon steel and has characteristics including a thickness of 0.1720 inches, a width of sixty inches (60 in), Young's Modulus of Elasticity of 30 Mpsi, and a minimum yield strength of approximately 50,000 psi. The material characteristics may be received via the user input interface 1002. The display 1200 includes a number 1202 of incremental plunge depth positions, entry gap values 1204 corresponding to the respective incremental plunge depth positions, and measured pressures 1206 associated with the incremental plunge depth positions. The display 1200 of the illustrated example also provides a total number of samples 1208 to be measured (e.g., 40 samples), a time delay 1210 for measuring the pressure values after an incremental plunge depth position is adjusted or positioned (e.g., a three second delay), an incremental plunge depth distance or value 1212 (e.g., 0.002 inches) between the incremental plunge depth positions, a thickness 1214 of the strip material (e.g., 0.1720 inches), a width of the strip material 1216 (e.g., 60 inches), a percent of cross section area to plastically yield 1218 (e.g., 80 percent), and a calculated gap setting window 1220 illustrating an entry gap of the entry work rolls (e.g., 0.087 inches), an exit gap of the exit work rolls (e.g., 0.172 inches), a minimum gap of the entry work rolls (e.g., 0.087 inches), and the maximum percent of cross section area of the strip material to be yielded (e.g., 80 percent).

The sequence illustrated by the display 1200 starts at gap positions 01 through 10. This example took ten readings to detect the plunge position associated with a lowest pressure reading 1222. The example plunge position determiner 1004 detected the increase in pressure in the readings 8-10 and determined based on these readings that no additional readings were needed (e.g., based on a difference or comparison with the pressure output at reading 1-7). The lowest or smallest pressure reading 1222 is at reading 7 in the column representing the number 1202 of incremental plunge depth positions. At reading 7, the plunge depth position is 0.0960 inches and the pressure reading associated with or corresponding to the plunge depth position of 0.096 inches at reading 7 is 730 pounds-per-square inch (e.g., 730 lbs/in$^2$). The calculated yield point given the material thickness, the material type and the pressure (730 lbs/in$^2$) provided at the plunge depth position of 0.096 inches is 48,583 lbs/in$^2$. Lab testing determined the actual yield for the sample strip material represented by FIG. 12 is 49,850 lbs/in$^2$. The calculated yield provided by the smallest pressure value at reading 7 and the actual test yield provided via lab testing is a difference of approximately 2.54%. Thus, the example plunge depth determiner 1004 of the illustrated example determined a plunge depth position that provides a stress to the strip material within three percent of the actual yield point of the strip material.

FIG. 13 illustrates an example method 1300 that may be used to implement the controller 520 and/or the calibrator 1016 of FIG. 10. More specifically, the method 1300 may be performed prior to receiving the strip material characteristic(s) at block 1102 of FIG. 11. In other words, the example method 1300 may be performed prior to a production run of the strip material 400.

To calibrate the position sensors and the pressure sensors, the calibrator initiates calibration (block 1302). To initiate the calibration, a calibration control may be selected via the user input interface 1002 and/or may be initiated prior to a production run.

To calibrate the position sensors 916*a-g* and the pressure sensors 920*a-g*, the work rolls 412 in each zone are adjusted to a closed position (block 1304). For example, the calibrator 1016 instructs or commands the plunge position adjustor 1006 to control the pumps 902*a-g* and provide a control fluid to the respective actuators 620, 712*a-f* until the lower work rolls 504 engage the upper work rolls 502. In some examples, a plurality of ground plates each having a known or substantially similar thickness may be positioned between the upper works rolls 502 and the lower work rolls 504 in each of the zones (e.g., the zones 802-814). In examples in which the calibration plates are employed, the lower work rolls 504 are adjusted until the lower work rolls 504 and the upper work rolls 502 engage respective opposing surfaces of the calibration plates positioned between the upper work rolls 502 and the lower work rolls 504 (e.g., spaced apart by a vertical distance defined by a thickness of the calibration plate(s)).

The controller 520 and/or the plunge position detector 1008 detects if the work rolls 412 in each zone are in the closed position (block 1306). If the work rolls 412 are not in the closed position, then the system returns to block 1304. If the work rolls 412 are in the closed position, the positioning valve controller 1018 causes the positioning valves 914*a-g* to move to a closed position for each zone associated with the work rolls 412 positioned in the closed position. In the closed position, the positioning valves 914*a-g* prevent or restrict the flow of the control fluid between the reservoir 904*a-g* and the respective chambers 808*a-f*.

If the work rolls 412 in each zone is in a closed position, the calibrator 1016 records the position value for each zone (block 1308) and the pressure values for each zone and/or actuators (block 1310). For example, after the positioning valves (e.g., the positioning valves 914*a-g*) are moved to the closed positions, the position value provided by the position sensors 916*a-g* corresponding to the plunge depth position and, thus, the stroke position of each of the respective actuators associated with the respective zones is recorded. Additionally, the pressure value provided by the pressure sensor 920*a-g* associated with the actuator or particular zone is recorded.

If all the recorded pressure values are equal or substantially equal (within ten percent) in each zone (block 1314), then the system records the plunge position value in each zone (block 1316) and correlates the pressure value in each zone to the respective recorded plunge position value (block 1318).

FIG. 14 is a block diagram of an example processor platform 1400 capable of executing the instructions of FIGS. 11 and 13 to implement the controller 520 of FIGS. 5 and 10. The processor platform 1400 can be, for example, a server, a personal computer, a mobile device (e.g., a cell phone, a smart phone, a tablet such as an iPad™), a personal digital assistant (PDA), an Internet appliance, a DVD player, a CD player, or any other type of computing device.

The processor platform 1400 of the illustrated example includes a processor 1412. The processor 1412 of the illustrated example is hardware. For example, the processor 1412 can be implemented by one or more integrated circuits, logic circuits, microprocessors or controllers from any desired family or manufacturer.

The processor 1412 of the illustrated example includes a local memory 1413 (e.g., a cache). The processor 1412 of the illustrated example is in communication with a main memory including a volatile memory 1414 and a non-volatile memory 1416 via a bus 1418. The volatile memory 1414 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1416 may be implemented by flash memory and/or any other desired type of memory device. Access to the main memory 1414, 1416 is controlled by a memory controller.

The processor platform 1400 of the illustrated example also includes an interface circuit 1420. The interface circuit 1420 may be implemented by any type of interface standard, such as an Ethernet interface, a universal serial bus (USB), and/or a PCI express interface.

In the illustrated example, one or more input devices 1422 are connected to the interface circuit 1420. The input device(s) 1422 permit(s) a user to enter data and commands into the processor 1412. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1424 are also connected to the interface circuit 1420 of the illustrated example. The output devices 1424 can be implemented, for example, by display devices (e.g., a light emitting diode (LED), an organic light emitting diode (OLED), a liquid crystal display, a cathode ray tube display (CRT), a touchscreen, a tactile output device, a printer and/or speakers). The interface circuit 1420 of the illustrated example, thus, typically includes a graphics driver card, a graphics driver chip or a graphics driver processor The interface circuit 1420 of the illustrated example also includes a communication device such as a transmitter, a receiver, a transceiver, a modem and/or network interface card to facilitate exchange of data with external machines (e.g., computing devices of any kind) via a network 1426 (e.g., an Ethernet connection, a digital subscriber line (DSL), a telephone line, coaxial cable, a cellular telephone system, etc.).

The processor platform 1400 of the illustrated example also includes one or more mass storage devices 1428 for storing software and/or data. Examples of such mass storage devices 1428 include floppy disk drives, hard drive disks, compact disk drives, Blu-ray disk drives, RAID systems, and digital versatile disk (DVD) drives.

The coded instructions 1100 and 1300 of FIGS. 11 and 13 may be stored in the mass storage device 1428, in the volatile memory 1414, in the non-volatile memory 1416, and/or on a removable tangible computer readable storage medium such as a CD or DVD.

From the foregoing, it will be appreciated that the above disclosed methods, apparatus and articles of manufacture use a pressure measured value to determine if a sufficient force is applied to plastically deform or yield the strip material (e.g., the strip material 400) passing through the nested work rolls (e.g., the work rolls 412). In this manner, the pressure measured value correlates to a force imparted to the strip material via the work rolls 412. The measured force can be used to determine if the force is sufficient to plunge (e.g., stretch or bend) the strip material 400 beyond its yield strength to release internal stresses (e.g., remove coil set) in the strip material 400.

At least some of the aforementioned examples include one or more features and/or benefits including, but not limited to:

In some examples, a method for setting a plunge depth of a leveler includes: incrementally adjusting, via an actuator, a first work roll relative to a second work roll between a plurality of incremental plunge depth positions; measuring a pressure value in the actuator at the respective incremental plunge depth positions; associating the measured pressure values with the corresponding incremental plunge depth positions; detecting a smallest one of the measured pressure values; and identifying a first one of the incremental plunge depth positions corresponding to the smallest one of the measured pressure values.

In some examples, the method includes processing a strip material at the identified first one of the incremental plunge depth positions.

In some examples, the method includes receiving material characteristics of the strip material prior to incrementally adjusting the first and second work rolls between the incremental plunge depth positions.

In some examples, the method includes receiving material characteristics by receiving a width value and a thickness value of the strip material.

In some examples, the method includes incrementally adjusting the first and second work rolls by incrementally adjusting a plunge depth between the first and second work rolls by a preset incremental value.

In some examples, the method includes incrementally adjusting the first and second work rolls by adjusting the first and second work rolls at an initial plunge depth position and adjusting the initial plunge depth by a preset incremental value.

In some examples, the method includes positioning a strip material in the leveler between the first work roll and the second work roll prior to incrementally adjusting the plunge depth positions.

In some examples, the method includes displaying, via a user interface, the incremental plunge depth positions and the measured pressure values corresponding to the respective incremental plunge depth positions.

In some examples, a tangible computer-readable medium comprising instructions that, when executed, cause a machine to: incrementally adjust, via an actuator, a first work roll relative to a second work roll between a plurality of incremental plunge depth positions; measure a pressure value in the actuator at the respective incremental plunge depth positions; associate the measured pressure values with the corresponding incremental plunge depth positions; detect a smallest one of the measured pressure values; and identify a first one of the incremental plunge depth positions corresponding to the smallest one of the measured pressure values.

In some examples, the instructions cause the machine to set a plunge depth between the first and second work rolls at the identified first one of the incremental plunge depth positions and process a strip material at the identified first one of the incremental plunge depth positions.

In some examples, the instructions cause the machine to receive material characteristics of the strip material prior to incrementally adjusting the first and second work rolls between the incremental plunge depth positions.

In some examples, the instructions cause the machine to receive material characteristics comprises receiving a width value and a thickness value of the strip material.

In some examples, the instructions cause the machine to incrementally adjust the first and second work rolls by incrementally adjusting a plunge depth between the first and second work rolls by a preset incremental value.

In some examples, the instructions cause the machine to incrementally adjust the first and second work rolls by adjusting the first and second work rolls at an initial plunge depth position and adjusting the initial plunge depth by a preset incremental value.

In some examples, the instructions cause the machine to display the incremental plunge depth positions and the measured pressure values corresponding to the respective incremental plunge depth positions.

In some examples, a leveler to condition a strip material includes a first plurality of entry work rolls, a second plurality of entry work rolls supported by an adjustable flight, and an actuator associated with the adjustable flight. The actuator incrementally adjusts a position of the adjustable flight to move the second plurality of entry work rolls relative to the first plurality of entry work rolls between a plurality of incremental plunge depth positions. A pressure sensor is coupled to the actuator to measure a pressure value in a control fluid of the actuator when the first and second work rolls are positioned at the respective incremental plunge depth positions. A controller is configured to determine a smallest one of the pressure values and identify a first one of the incremental plunge depth positions corresponding to the smallest one of the pressure values.

In some examples, the controller adjusts the first and second work rolls to the identified first one of the plunge depth positions.

In some examples, the adjustable flight includes a plurality of adjustable flights to define respective zones across a width of the strip material.

In some examples, the actuator includes a plurality of actuators associated with respective ones of the adjustable flights, the actuators to adjust positions of the respective ones of the adjustable flights to enable each of the zones to be positioned between the incremental plunge depth positions.

In some examples, the pressure sensor comprises a plurality of pressure sensors coupled to a respective one of the actuators, each pressure sensor to detect pressure changes in a control fluid of its respective actuator.

In some examples, the controller adjusts the plunge depth position of each of the zones to the first one of the plunge depth positions corresponding to the smallest pressure value.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

What is claimed:

1. A method for setting a plunge depth of a leveler comprising:

incrementally adjusting, via an actuator, a first work roll relative to a second work roll between a plurality of incremental plunge depth positions;

measuring a pressure value in the actuator at the respective incremental plunge depth positions;

associating the measured pressure values with the corresponding incremental plunge depth positions;

detecting a smallest one of the measured pressure values; and identifying a first one of the incremental plunge depth positions corresponding to the smallest one of the measured pressure values.

2. The method of claim 1, further comprising processing a strip material at the identified first one of the incremental plunge depth positions.

3. The method of claim 2, further comprising receiving material characteristics of the strip material prior to incrementally adjusting the first and second work rolls between the incremental plunge depth positions.

4. The method of claim 3, wherein receiving material characteristics comprises receiving a width value and a thickness value of the strip material.

5. The method of claim 1, wherein incrementally adjusting the first and second work rolls comprises incrementally adjusting a plunge depth between the first and second work rolls by a preset incremental value.

6. The method of claim 1, wherein incrementally adjusting the first and second work rolls comprises adjusting the first and second work rolls at an initial plunge depth position and adjusting the initial plunge depth by a preset incremental value.

7. The method of claim 1, further comprising positioning a strip material in the leveler between the first work roll and the second work roll prior to incrementally adjusting the plunge depth positions.

8. The method of claim 1, further comprising displaying, via a user interface, the incremental plunge depth positions and the measured pressure values corresponding to the respective incremental plunge depth positions.

9. A tangible computer-readable medium comprising instructions that, when executed, cause a machine to:

incrementally adjust, via an actuator, a first work roll relative to a second work roll between a plurality of incremental plunge depth positions;

measure a pressure value in the actuator at the respective incremental plunge depth positions;

associate the measured pressure values with the corresponding incremental plunge depth positions;

detect a smallest one of the measured pressure values; and identify a first one of the incremental plunge depth positions corresponding to the smallest one of the measured pressure values.

10. The tangible computer-readable medium as defined in claim 9 comprising instructions that, when executed, cause the machine to set a plunge depth between the first and second work rolls at the identified first one of the incremental plunge depth positions and process a strip material at the identified first one of the incremental plunge depth positions.

11. The tangible computer-readable medium as defined in claim 10 comprising instructions that, when executed, cause the machine to receive material characteristics of the strip material prior to incrementally adjusting the first and second work rolls between the incremental plunge depth positions.

12. The tangible computer-readable medium as defined in claim 11 comprising instructions that, when executed, cause the machine to receive material characteristics comprises receiving a width value and a thickness value of the strip material.

13. The tangible computer-readable medium as defined in claim 9 comprising instructions that, when executed, cause the machine to incrementally adjust the first and second work rolls by incrementally adjusting a plunge depth between the first and second work rolls by a preset incremental value.

14. The tangible computer-readable medium as defined in claim 9 comprising instructions that, when executed, cause the machine to incrementally adjust the first and second work rolls by adjusting the first and second work rolls at an initial plunge depth position and adjusting the initial plunge depth by a preset incremental value.

15. The tangible computer-readable medium as defined in claim 9 comprising instructions that, when executed, cause the machine to display the incremental plunge depth positions and the measured pressure values corresponding to the respective incremental plunge depth positions.

16. A leveler to condition a strip material, the leveler comprising:

a first plurality of entry work rolls;

a second plurality of entry work rolls supported by an adjustable flight;

an actuator associated with the adjustable flight, the actuator to incrementally adjust a position of the adjustable flight to move the second plurality of entry work rolls relative to the first plurality of entry work rolls between a plurality of incremental plunge depth positions;

a pressure sensor coupled to the actuator, the pressure sensor to measure a pressure value in a control fluid of the actuator when the first and second work rolls are positioned at the respective incremental plunge depth positions; and a controller programmed with instructions to determine a smallest one of the pressure values and identify a first one of the incremental plunge depth positions corresponding to the smallest one of the pressure values.

17. The leveler of claim 16, wherein the controller adjusts the first and second work rolls to the identified first one of the plunge depth positions to condition the strip material.

18. The leveler of claim 16, wherein the adjustable flight comprises a plurality of adjustable flights to define respective zones across a width of the strip material.

19. The leveler of claim 18, wherein the actuator comprises a plurality of actuators associated with respective ones of the adjustable flights, the actuators to adjust positions of the respective ones of the adjustable flights to enable each of the zones to be positioned between the incremental plunge depth positions.

20. The leveler of claim 19, wherein the pressure sensor comprises a plurality of pressure sensors coupled to a respective one of the actuators, each pressure sensor to detect pressure changes in a control fluid of its respective actuator.

21. The leveler of claim 20, wherein the controller is to adjust the plunge depth position of each of the zones to the first one of the plunge depth positions corresponding to the smallest pressure value.

22. The leveler of claim 16, wherein the controller is to move the actuator associated with the adjustable flight between the plurality of incremental plunge depth positions and associate the measured pressure values with the corresponding incremental plunge depth positions.

* * * * *